US012467237B1

(12) United States Patent
Rezzoug et al.

(10) Patent No.: US 12,467,237 B1
(45) Date of Patent: Nov. 11, 2025

(54) WELL RESCUE AND SUPPORT SYSTEM

(71) Applicant: IMAM MOHAMMAD IBN SAUD ISLAMIC UNIVERSITY, Riyadh (SA)

(72) Inventors: Aissa Rezzoug, Riyadh (SA); Omar Eid Almutairi, Riyadh (SA); Nadir Murtaza, Rawalpindi (PK); Diyar Khan, Rawalpindi (PK)

(73) Assignee: IMAM MOHAMMAD IBN SAUD ISLAMIC UNIVERSITY, Riyadh (SA)

( * ) Notice: Subject to any disclaimer, the term of this patent is extended or adjusted under 35 U.S.C. 154(b) by 0 days.

(21) Appl. No.: 19/170,361

(22) Filed: Apr. 4, 2025

(51) Int. Cl.
*A62B 1/02* (2006.01)
*E02F 9/24* (2006.01)

(52) U.S. Cl.
CPC ..... *E02F 9/245* (2013.01)

(58) Field of Classification Search
CPC ... E02F 9/245; A62B 1/02; A62B 3/00; A62B 31/00; A62B 99/00; B61B 12/005; B63C 9/01; B63G 8/40; E01F 11/00; F17C 2270/0772; E04G 3/32; B66D 3/00
See application file for complete search history.

(56) References Cited

U.S. PATENT DOCUMENTS 3,995,694 A * 12/1976 Freiburger ..... E21B 33/13 137/71
4,499,844 A * 2/1985 Parish ..... B63C 9/22 114/367
5,011,329 A * 4/1991 Nelson ..... E21B 36/008 405/131
5,411,083 A * 5/1995 Freiburger ..... E21B 33/127 403/31

(Continued)

FOREIGN PATENT DOCUMENTS

CN 202096625 U 1/2012
CN 104234746 B 6/2016

(Continued)

OTHER PUBLICATIONS

A. Devi et al.; "Octobot for Child Rescue from Open Bore Well", 2023 Third International Conference on Smart Technologies, Communication and Robotics (STCR), Dec. 2023, 6 pages.

*Primary Examiner* — Edwin J Toledo-Duran
(74) *Attorney, Agent, or Firm* — Oblon, McClelland, Maier & Neustadt, L.L.P.

(57) ABSTRACT

A well rescue and support system includes a controller having a processor with program instructions, a compressed gas output valve and a dashboard having a screen and a keypad. A compressed air tank with a regulator connects to the output valve, and a well cap fills a well opening. An extendable tube fluidly connects to the compressed air tank through the output valve. At least one retaining balloon (Continued)

disposed around the extendable tube inflates within the well to apply wall pressure. A communication head with a microphone, a camera, a control wire, and a speaker attach to a balloon end of the extendable tube, connecting to the processor and dashboard through a coaxial cable inside the extendable tube. The processor delivers inflation/deflation signals to balloon valves to control target volumes of the retaining balloons for preventing well collapse during rescue operations.

19 Claims, 14 Drawing Sheets

(56) References Cited

U.S. PATENT DOCUMENTS 5,709,505 A * 1/1998 Williams ..... B09C 1/02 166/268
5,787,984 A * 8/1998 Mabile ..... E21B 27/00 166/207
6,497,290 B1 * 12/2002 Misselbrook ..... E21B 49/08 166/77.2
7,360,595 B2 * 4/2008 Zupanick ..... E21B 41/0064 166/279
2002/0066308 A1 * 6/2002 Shapiro ..... E21B 49/00 73/152.18
2007/0144249 A1 * 6/2007 Masuda ..... G01N 3/32 73/152.59
2009/0178797 A1 * 7/2009 Heller ..... E21B 41/0064 166/69
2012/0125641 A1 * 5/2012 Barrash ..... E21B 33/1243 166/120
2012/0305260 A1 * 12/2012 Paturu ..... E21B 33/127 166/357
2013/0043092 A1 * 2/2013 Clardy ..... E06C 9/14 182/163
2015/0306433 A1 * 10/2015 Aldakkan ..... E04G 3/32 297/217.1
2015/0306434 A1 * 10/2015 Alhusseini ..... E04G 3/32 297/464
2016/0187524 A1 * 6/2016 Suhami ..... G01V 3/30 324/339
2017/0368385 A1 * 12/2017 Werz ..... A62B 33/00
2018/0272616 A1 * 9/2018 Pionetti ..... B29C 66/73921
2019/0017358 A1 * 1/2019 Morse ..... E21B 43/243
2020/0157909 A1 * 5/2020 Fernandes ..... E21B 23/08
2021/0062626 A1 * 3/2021 Jordan, Jr. ..... E21B 34/08

FOREIGN PATENT DOCUMENTS

CN 106730480 A * 5/2017 ..... A62B 99/00
CN 206366110 U * 8/2017
CN 107412972 A 12/2017
CN 108525155 A 9/2018
CN 110333332 A * 10/2019 ..... G05D 27/02
CN 210228933 U 4/2020
CN 213180097 U * 5/2021
CN 114909103 A * 8/2022 ..... E21B 34/04
DE 19782248 B4 * 10/2005 ..... A62B 1/20
DE 102018005497 A1 * 1/2020 ..... E21F 11/00

* cited by examiner

WELL RESCUE AND SUPPORT SYSTEM

BACKGROUND

Technical Field

The present disclosure is directed to rescue equipment and systems, and more particularly to a system for rescuing and supporting to provide comfort to the individuals trapped in wells using retaining balloons and life support equipment performing vertical excavation operation around the bore well opening.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Wells and drillings, particularly abandoned or uncovered, present a significant safety hazard worldwide, especially to children. According to World Health Organization statistics, falls represent the second leading cause of accidental injury deaths globally, with a substantial portion occurring in wells and similar confined spaces. These incidents are particularly prevalent in rural areas where abandoned wells and drillings may be left uncovered after becoming dry or inactive. These incidents have been increasingly India, Saudi Arabia, Tunisia, Turkey and many other african and asiatic countries, highlighting the urgent need for preventive measures. In the following text of this document, we will use the word "well" or "bore well" that signify all kind wells, bore wells and drillings.

Traditional rescue operations in well environments face several challenges such as the risk of well wall collapse during rescue attempts, limited access to the trapped individual, and the need to provide immediate life support such as oxygen, light, heat, water, food and communication capabilities, with controlling some comfort parameters like the temperature and moisture. Conventional rescue methods often involve horizontal excavation or excavation alongside the well or the use of mechanical equipment to extract the trapped individual. These approaches frequently require extensive time and resources, during which the victim's condition may deteriorate due to lack of oxygen, psychological stress, and potential injuries. Additionally, the mechanical disturbance caused by traditional rescue operations may destabilize the well structure, potentially leading to collapse and further endangering both the victim and rescue personnel. The duration of typical rescue operations for children who fell in wells reaches seven days based on current rescue facility availability. The demand for a fast dependable rescue system that ensures safety becomes critical because of recent incidents. Traditional and manual rescues are possible for wells larger than 50 cm diameter. Rescuers cannot access wells smaller than 50 cm diameter. A specialized and efficient system becomes necessary to protect trapped victims or children while minimizing their injuries in these emergency situations. Different patented rescue solutions have sought to resolve problems related to recovery challenges. A device used a location and signaling balloon that maintained its length by attaching to a lighter-than-air gas through a tethering method (U.S. Pat. No. 4,944,242A). A different device implemented water pipe technology that incorporated two balloons to rescue a trapped child (CN107412972A). The rescue tool included a rod combined with a main rope as well as an auxiliary rope and a pull rod equipped with a head-mounted rescue device (CN201418967Y). Another device utilized balloon technology which controlled positioning and inflation through specialized retaining units (US20230056199A). An emergency locating device equipped injured subjects with balloons that could be activated using only one hand (U.S. Pat. No. 5,301,631A). A method of bore well rescue technology combines smart technology with Raspberry Pi to monitor in real time and detect emotions while controlling the bore well (CN202441029564A). A system with an emergency balloon securing line and wind-up reel enabled controlled air inflation (U.S. Pat. No. 5,429,244A).

The device disclosed in U.S. Pat. No. 10,857,401B2 uses clamp assembly to provide support to the torso of the victim while moving the victim out of the bore well. Moreover, the disclosure uses a seat assembly configured to provide seating support to the victim while rescuing.

U.S. Pat. No. 10,765,896B2 disclosed a rescue device comprising of a support assembly with holding arms and seating assembly. The holding arms are utilized to hold the victim from its shoulders. While the seating assembly is configured to move relative to the extendable seat rod to facilitate the positioning of seat relative to the victim. The state of the art work uses support devices which are inserted in the well to support the victim, either from the shoulders or by providing a seat to support the back of victim. The seat which is used to support the victim from downside is considered for victim to sit. However, these systems are hard to apply in real situations especially when the well hole size is less than or equal to 30 cm or in case of non-stable and/or irregular well wall.

The existing devices either hold the victim from head in AU2020102027A4 which is risky for small children to hurt their head or neck. There are some other devices which uses clamp assembly to provide support to the torso of the victim while moving the victim U.S. Pat. No. 10,857,401B2 or uses support assembly with holding arms and seating assembly U.S. Pat. No. 10,765,896B2. These devices have structures which are inserted in the narrow bore well and have size limitations to inset in the bore well of more than 30 cm diameter with stable and regular well wall. As some bore well size is smaller than 30 cm, or having non-stable or non-regular well wall like the most of the cases, the systems developed in state of the art may not be used to save the life of the victim. These devices are risky, and victims may die during the rescue operations due to lack of supply of oxygen, light, water, food and due to uncomfortable conditions of temperature, pressure, moisture etc.

No existing technical solution provides complete protection against well collapse risks during rescue operations and stabilization of entrapped individuals as well as direct operational assistance for rescue teams. As such an embodiment of the present disclosure provides a Well Rescue and Support System that enhances unified soil stabilization systems and dynamic communication along with modular control features. The system is capable of controlling the retaining balloons through dashboard operations so operators can stop soil collapse while the system maintains lifelong basic operations including oxygen supply, temperature control, and two-way communications. This system provides complete protection to a child since it runs continuously from extraction until the process ends thus shortening rescue time and boosting survival odds. The modular design enables its use in multiple well environments to solve one of the main limitations in present well-rescue systems.

As some bore well size is smaller than 30 cm, the traditional systems cannot be used to save the life of the victim. These devices are risky, and victims may die during the rescue operations due to lack of life needs under uncomfortable conditions.

Accordingly, it is one object of the present disclosure to provide a well rescue and support system for rescuing individuals trapped in well structures, while simultaneously providing life support and comfort to the individuals and ensuring structural integrity of the well throughout the rescue operation.

SUMMARY

In an exemplary embodiment, a well rescue and support system is described, comprises of excavator device, E-data module, V-data module, extendable tube, a controller having optimizer, control module, output module and execution module. The controller is connected with various devices to control the flow of various supplies which are needed by the trapped victim or child in the well during rescue operation, including a compressed air tank with output valve and a dashboard having a screen and a keypad; a compressed air tank having a regulator, the regulator connected to the compressed gas output valve of the controller by a first tube; a well cap configured to cover an opening of a well, the well cap having a solid conical body with an axial passage is significant to protect falling of any harmful item to enter in bore opening; an extendable tube passing from the dashboard through the axial passage of the solid conical body, the extendable tube fluidly connected to the compressed air tank through the output valve or any other device for supplies, wherein the extendable tube is connected to V-data module which is linked with the controller through a communication medium; at least one retaining balloon disposed around the extendable tube and along an axis of the extendable tube, wherein the retaining balloon is proximal to a well end of the extendable tube; and a communication head having duality of sensors and actuators for communication with controller through communication medium including but not limited to microphone, a camera, a control wire, and a speaker, the communication head attached to a balloon end of the extendable tube, wherein the control wire or any other kind of communication medium is electrically connected to the controller and the dashboard of the controller by a coaxial cable disposed inside the extendable tube, wherein the program instructions to various actuators on the communication head and other parts of the system for moving the extendable tube into the well and delivering an inflation signal or a deflation signal to a balloon valve located in each retaining balloon, the balloon valve configured to inflate or deflate the retaining balloon within the well structure to a target volume and thereby apply a pressure on a wall of the well to prevent the well from collapsing.

The extendable tule is inserted in the bore well from the top of the well. The extendable tube comprises duality of retaining balloons, air flow mechanism, data transfer mediums, duality of sensors, actuators, devices, and communication head. In the present invention, the retaining balloons on the extendable tune are filled with air and an air flow mechanism controls the flow of air into or out of the retaining balloons to control their size of retaining balloons in the bore well through instructions obtained from the execution module of controller. The invention protects the victim utilizing plurality of retaining balloons on the extendable tube of the device which is inserted in the bore well from top. One end of the extendable tube is configured to connect with the V-date module through any kind of data transfer medium while the other end is configured to connect with the communication head.

In the present invention, the extendable tube is configured to install duality of sensors and actuators to measure various variable values which are related to the comfort of the victim in the bore well including but not limited to temperature, pressure, air quality and pressure, oxygen quality and its pressure, light, food, water etc. In the present disclosure, the sensors on the communication head of extendable tube includes but not limited to temperature sensors, pressure sensors, oxygen sensors, humidity sensors, camera, light sensor, etc to get the real time data of various variable values which are related to the comfort of the victim in the well including but not limited to temperature, pressure, air quality and pressure, oxygen quality and its pressure, light, food, water etc. from victim and the bore well. Moreover, the communication head is configured to install various devices on it to produce changes in the values of various parameters which are related to the comfort of the victim in the well including but not limited to, temperature control device, pressure control device, air quality control device, oxygen control device, light control device, water control device and any other devices related to the comfort of the victim in the well. The devices on the communication head of the extendable tube includes but not limited to the devices to provide air, oxygen, temperature, pressure, food, water etc.

In some embodiments, each retaining balloon is formed from at least one elastomeric material selected from the group consisting of a rubber, a polyurethane, a polybutadiene, a polychloroprene, silicone and any other type of soft and elastic and stretchable material. When a child is trapped in a well with a diameter of less than 50 cm, or in a well with unstable walls, it becomes challenging to secure the child because manual rescue is not possible. this disclosure provides an innovative solution for rescuing a child from a well with a diameter less than 50 cm or in a well with unstable and/or irregular walls, where manual access is not feasible under normal circumstances. The current invention offers several life support supplies and also have mechanism to control moisture. The system proposed in this patent includes a set of equipment designed for use during the rescue operation. The microphone, used for communication, allows the rescue worker to interact with the child trapped in the well. These microphones are connected to the dashboard controller screen. The compressed oxygen tank and dashboard controller are located at the ground surface of the vessel. The coaxial pipes, retaining balloons, and communication heads are all pre-arranged for use in the next phase of installation. The purpose of the dashboard controller screen is to regulate the supply of all required supplies for trapped victim including but not limited to oxygen, light, temperature . . . etc, for the child. Additionally, it shows the depth of the retaining balloons. Once the rescue worker reaches the last balloon, it becomes easier to secure the child. These three balloons prevent well walls from deterioration, which is critical to prevent the child from being harmed by falling soil or stones. The communication head provides information about the child trapped in the well and also serves as a heat and light sources. It contains sensors and actuators for providing comfort to the trapped child or any victim. The well is covered with well cap\cork stopper) to prevent soil and stones from falling onto the balloons. The coaxial pipes pass through the well cap (cork stopper). The soil pump (excavator) excavates the soil around the well opening and dumps it into a truck for removal.

In the present disclosure, the data transfer medium is connected with various sensors and devices on the communication head of the extendable tube and also connected with the V-data module where these data transfer mediums transmit the real time data from sensors which are installed on the communication head of the extendable tube.

In the present disclosure, the V-data module filters the data of variables and sends the filtered data to optimizer of the controller. The optimizer processes the data and identifies optimal values for the variables which are related to the comfort of the victim and sends the optimal values of variables to execution module. The execution module is configured to convert the optimal values of variables into instructions for relevant devices of the variables. The execution module executes the instructions to all devices which are installed on the system including devices on excavation device, extendable tube, communication head or anywhere installed on the system to perform excavation or protect the victim and provide necessary items to the victim for survival and comfort.

In the present invention, the extendable tube is inserted in the bore well from top and it is moved down the well until the communication head of extendable tube approaches the head of victim. The communication head is configured to take real time data of victim and bore well utilizing sensors which are installed on communication head of the extendable tube. Moreover, the devices installed on the communication head of the extendable tube provide necessary items to the victim as per instructions obtained from the execution module of the disclosed system. In some embodiments, each retaining balloon has a pressure sensor configured to reduce pressure within the retaining balloon and communicate pressure data to the controller.

In the present invention, the size of retaining balloons is controlled by adding and removing air from the balloons through air flow control mechanism. Once the extendable tube is inserted in the bore well and the communication head reaches near the head of victim, air flow control mechanism injects air into the balloons to increase their size and make their contact with the boundary wall of the well. This contact helps to provide sealing and protects falling of soil or other material or any other thing which can harm the head of victim from top and helps to protect the head of victim. The disclosed system and device protect the victim and provide necessary items which are needed by the victim in the well during rescue and excavation operation including but not limited to light, air, oxygen, temperature, water, food . . . etc. and communication capabilities in the bore well during the rescue operation. The rescue operation is performed through an excavation device vertically and once the communication head is inserted in the well the V-data module receives real time data from various sensors which are installed on the communication head of the extendable tube. Vertical excavation device is utilized in the disclosed system for excavation around the well opening. The excavator device could be any device that could be used for digging and excavation operation in the rescue including but not limited to manual device, machinery, drilling device etc. Sensors to measure the values of variables which are related to the soil and land are installed on the excavation device. The real time data of the soil and land is measured by the sensors and it is passed to the E-data module. The E-data module filters the real time data of all variables which are related to the soil and land excavation and sends it to the optimizer of controller. The optimizer identifies optimal values of the variables which are related to the excavation operation which can help in performing excavation operation safely for protection of the victim. The optimizer sends the optimal values of variables which are related to excavation operation to the execution module. The execution module converts the optimal values of variables into instructions for the excavator. The excavator operates and performs excavation operation by the instructions obtained from the execution module through vertical excavation of the land around the bore well utilizing any kind of excavation device/equipment/resources etc. The excavation operation is performed until the first retaining balloon of the extendable tube appears in the cavity created during excavation. When the retaining balloon appears, the air pressure control mechanism removes air from it and makes its size small, keeping air pressure unchanged in the remaining two other retaining balloons. The retaining balloon of small size and empty with air provides space to the excavator to dig deeper around the bore well. The excavator device excavates the land until the next retaining balloon appears in the cavity created by the excavator around the bore well. The air control mechanism again removes air from it keeping air pressure unchanged in the last retaining balloon. The same process is performed by the excavator device one after the next retaining balloon until the communication head of the head top of the protecting rod is reached and appears in the cavity created by excavation operation. Once, the communication head of the extendable tube appears, the excavation process is performed with more care until the head of victim appears and the victim can be taken out of the bore well safely.

In some embodiments, the coaxial cable is configured to carry a visual and an audio signal received from the communication head to the control dashboard, and wherein the dashboard is configured to display the visual signal on the screen.

In some embodiments, the screen is at least one selected from the group consisting of a liquid-crystal display (LCD) screen, a light-emitting diode (LED) screen, and an organic light-emitting diode (OLED) screen.

In some embodiments, each retaining balloon is formed of a polyurethane or any other type of soft and stretchable non-porous material.

In some embodiments, the controller further comprises at least three legs disposed at the bottom end of the controller being attached to configured to stabilize the controller, wherein each leg comprises a flexible joint configured to collapse when the system is not in use.

In some embodiments, the controller further comprises a pressure monitor in communication with the pressure sensor of each retaining balloon.

In some embodiments, the system further comprises a gas delivery tube fluidly connected to the compressed gas tank through the controller, and wherein the processor comprises instructions to provide gas from the compressed gas tank to each nozzle (valve) located inside each balloon.

In some embodiments, the extendable tube is formed from at least one selected from the group consisting of polyvinyl chloride (PVC), stainless steel, aluminum, and carbon steel.

In some embodiments, the continuous flow of the oxygen is delivered to one nozzle on the communication head at an adjustable predefined flow rate as per requirements.

In some embodiments, the well cap comprises at least one light and flexible material selected from the group consisting of a silicone, rubber, cork, and polyurethane.

In some embodiments, the system further comprises at least one shore protection structure located along the extendable tube, the shore protection structure configured to strengthen soil located along at least on two opposite wall faces of the excavated well structure.

In some embodiments, the camera is an infrared camera or any other type of camera or device configured to capture images or make live video of the child inside the well.

In some embodiments, each retaining balloon is configured to receive a separate amount of oxygen through each inflation valve to inflate each retaining balloon to the target volume, and wherein each retaining balloon is configured to individually inflate to a different target volume.

In some embodiments, the communication head further comprises a pressure sensor configured to detect a change in pressure within the well. The communication head is configured to install sensors and actuators to measure various variable values which are related to the comfort of the victim/child in the well including but not limited to temperature, pressure, air quality and pressure, oxygen quality and its pressure, light, food, water . . . etc.

In the present disclosure, the sensors installed on the communication head includes but not limited to temperature sensors, pressure sensors, oxygen sensors, humidity sensors, camera, light sensor, etc to get the real time data of various variable values which are related to the comfort of the victim in the well including but not limited to temperature, pressure, air quality and pressure, oxygen quality and its pressure, light, food, water etc. from victim and the bore well. Moreover, the communication head is configured to install various devices on it to produce changes in the values of various parameters which are related to the comfort of the child in the well including but not limited to, temperature control device, pressure control device, air quality control device, oxygen control device, light control device, water control device and any other devices related to the comfort of the victim in the well. The devices on the communication head includes but not limited to the devices to provide air, oxygen, temperature, pressure, food, water . . . etc. This summary is presented to introduce the selection of concepts in simplified form of the subject matter; these concepts are further illustrated in the Detailed Description. This summary is not intended to identify key features and functions of the claimed subject matter, nor is it intended to be used to limit the scope of claimed subject matter. The foregoing general description of the illustrative embodiments and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings.

DETAILED DESCRIPTION

Figure 1A:
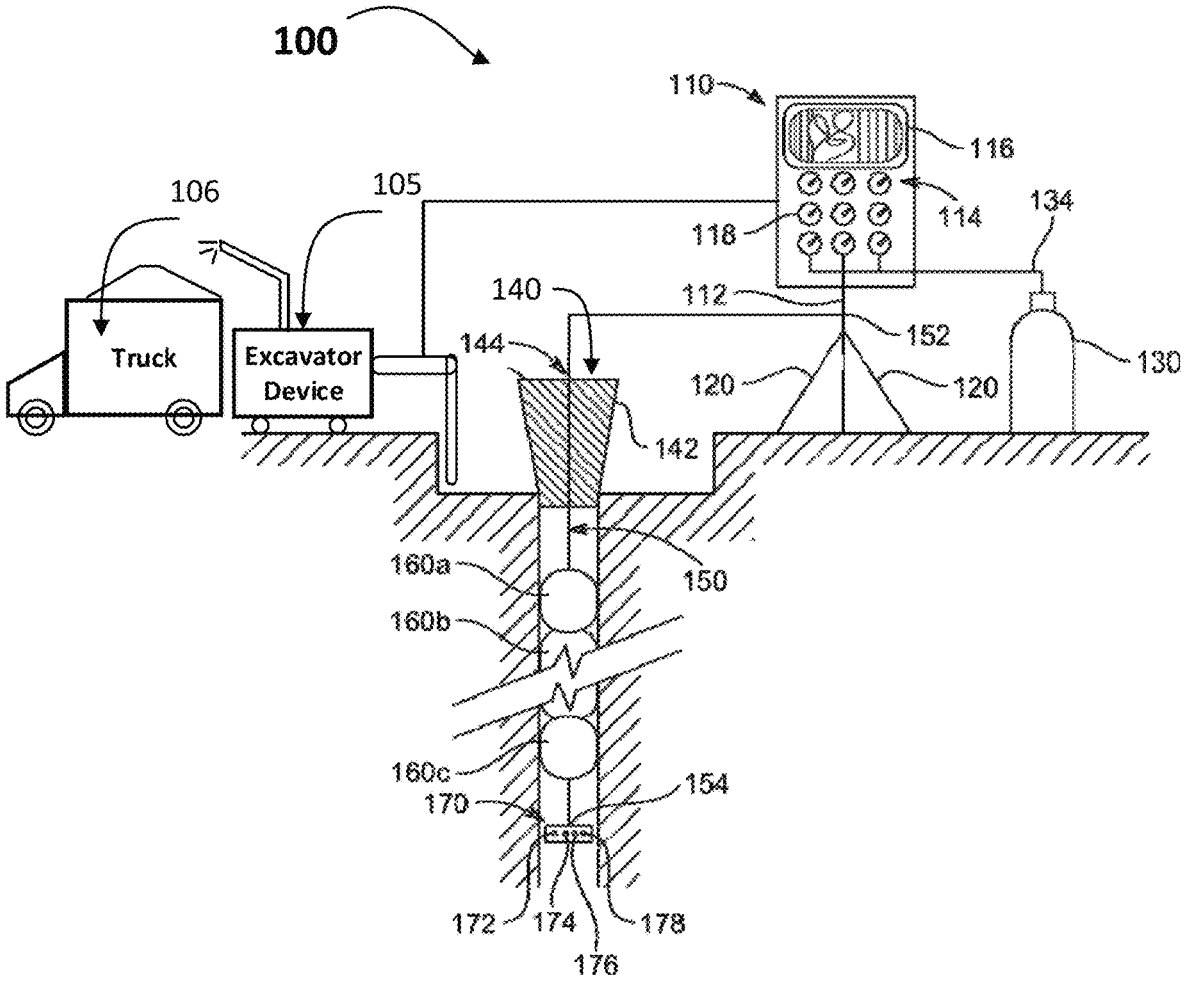
FIG. 1A is an exemplary schematic representation of the present disclosure in accordance with the other embodiments.

In the drawings, like reference numerals designate identical or corresponding parts throughout the several views. Further, as used herein, the words "a," "an" and the like generally carry a meaning of "one or more," unless stated otherwise.

Furthermore, the terms "approximately," "approximate," "about," and similar terms generally refer to ranges that include the identified value within a margin of 20%, 10%, or preferably 5%, and any values therebetween.

As used herein, 'physical screen' refers to a traditional display device that responds to interaction from a user through an input device, preferably separate from the screen, like a mouse or keyboard.

As used herein, 'touch screen' refers to a display device which allows the user to interact with a computer device by touching areas on the display device.

As used herein, 'elastomeric material' refers to a rubber-like material that can be deformed, e.g., stretched, and return to an original shape. Elastomeric materials are preferably made of cross-linked polymers, which may be natural or synthetic.

Aspects of this disclosure are directed to a well rescue and support system for rescuing individuals trapped in well structures while simultaneously providing life support and ensuring structural integrity throughout the rescue operation.

The well rescue and support system 100 of the present disclosure is designed for deployment across a range of emergency scenarios, providing an adaptable approach to well rescue operations while maintaining the safety of the individual being rescued and the structural integrity of the well. Examples of emergency scenarios, or emergency response situations, where the disclosed well rescue and support system is utilized may include an individual being stuck in any type of well, such as water wells, drillings and oil and gas wells, or geological formation, such as sinkholes, caves, crevasses, and the like. The well rescue and support system incorporates multiple coordinated subsystems working in conjunction to stabilize the rescue environment, maintain communication with trapped individuals, and facilitate safe extraction procedures. The well rescue and support system of the present disclosure enables rescue teams to respond more effectively to emergency situations involving individuals trapped in wells or other geological formations, while minimizing risks to both the trapped individuals and rescue personnel.

The well rescue and support system 100 of the present disclosure is configured for emergency response situations by integrating multiple functions into a unified rescue platform, enabling synchronized operation of well stabilization mechanisms, life support systems, and communication capabilities, allowing rescue teams to maintain optimal control throughout the operation. Referring to FIG. 1A, the well rescue and support system 100 has a modular design which accommodates various well configurations and depths, while its adaptive capabilities enable real-time monitoring and responses to changing rescue conditions. The well rescue and support system 100 further incorporates advanced monitoring and control features to provide rescue personnel with comprehensive situational awareness while maintaining stable rescue conditions. As further illustrated in FIG. 1A, the well rescue and support system 100 comprises a controller 110 that serves as a central command center for rescue operations. The controller 110 comprises an optimizer 500, control module 600, output module 700 and execution module 800. An optimizer 500 comprises of models and algorithms which are programmed with instructions for determining optimal values of the various supplies which are needed by the victim in the well and optimal values of other actuators installed in the system including but not limited to the actuators for optimal supply of air, water, oxygen, light, food, temperature, pressure, air, air quality, position of excavator device and any other control parameters in the system 100 . . . . The controller 110 further comprises actuators including but not limited to compressed gas output valve 112 and a dashboard 114 having a screen 116 and a keypad 118. The controller 110 is configured for centralized management of all operational aspects of the well rescue and support system 100, including monitoring real time situation of excavation operation and real time condition of the victim and bore well and control various variables which are linked with the performance of the excavation operation and which are related with the comfort of the victim in bore well.

Figure 1B:
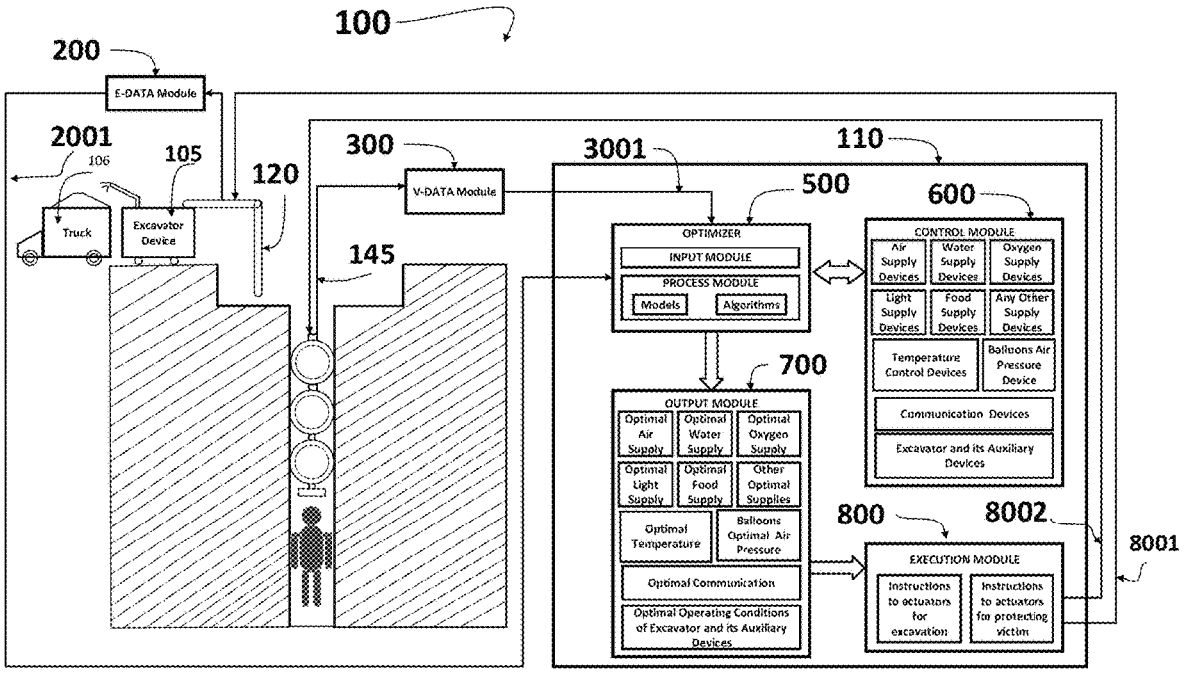
FIG. 1B is an exemplary schematic representation with detailed mechanism of controller of the present disclosure in accordance with the other embodiments.

FIG. 1B illustrates the system 100 with details of the controller 110 to rescue victim from bore well comprises of an excavator device 105, an E-data module 200, V-data module 300, a extendable tube 150, a controller 110 comprising of an optimizer 500, control module 600, output module 700 and execution module 800. Excavator device 105 is utilized to perform vertical excavation operation around the well opening and throws the soil in truck 106 or any other soil transport equipment and shares real time data of variable which can influence on the performance of the excavation operation with the optimizer 500 of controller 110 from E-data module 200 through information sharing medium 2001. V-data module 300 is utilized to receive real time data of variables which can influence the life and comfort of victim from extendable tube 150 through any kind of data transfer or communication medium 145. V-data module 300 is utilized to transfer real time data of variables which can influence the life and comfort of the victim through information sharing medium 3001 with optimizer 500 of the controller 110. An optimizer 500 is utilized to compute optimal values of the variables which can influence on the performance of excavator device 105 and which can influence on the life and comfort of the victim and shares with the execution module 800 and control module 600. The control module 600 in the disclosed system 100 is utilized to share the real time information of all variables which can influence on the performance of excavation utilizing excavator and its auxiliary devices to control the performance of the excavator device 105. Moreover, the control module 600 in the disclosed system 100 is utilized to share real time information from extendable tube 150 which can influence on the life and comfort of the victim including but not limited to air supply device 601, water supply device 602, oxygen supply device 603, light supply device 604, food supply device 605 other supply devices 606, temperature control devices 607, balloon air pressure devices 608 etc. An output module 700 shares an optimal value of all variables with the execution module 800. The execution module 800 converts the optimal values of all variables which can influence on the performance on the excavation process including optimal operating conditions of excavator and its auxiliary devices and convent them into instructions and shares them with the excavation device 105 through information sharing medium 8001 to control the excavator device 105.

Figure 1C:
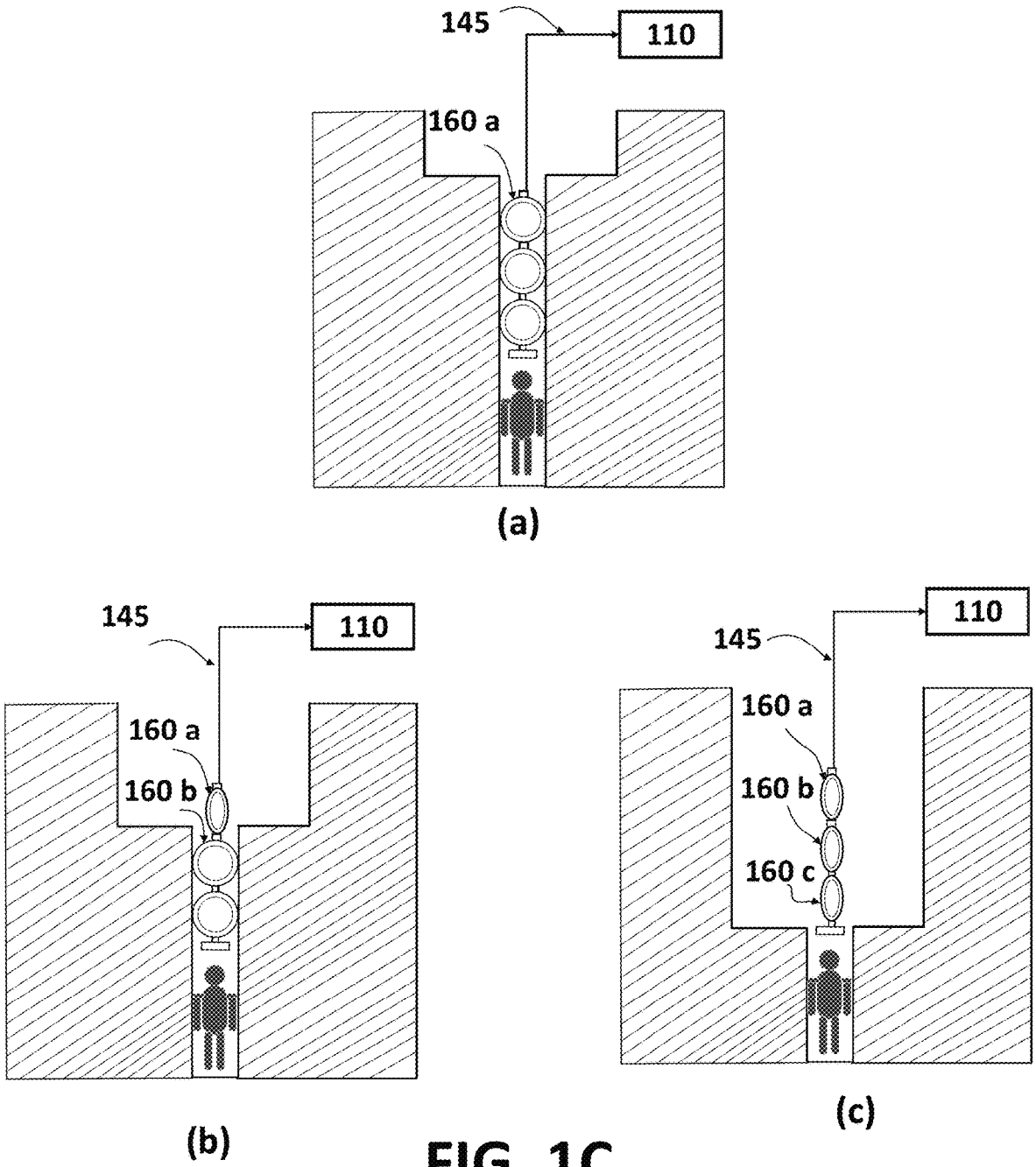
FIG. 1C is an exemplary representation of the three phases of well rescue operation, once the excavator reached the retaining balloons in the bore well.

FIG. 1C illustrates block diagram of three phases of vertical excavation; wherein FIG. 1B (a) shows extendable tube 150 containing retaining balloons filled with air and vertical excavation is performed around the bore well opening and the retaining balloon 160*a* in the bore well is just to reach during the excavation operation. Wherein FIG. 1 B(b) shows extendable tube 150 containing retaining balloon 160*a* from where air is removed from it and the remaining retaining balloons 160*b* and 160*b* are filled with air and vertical excavation is performed around the bore well and the retaining balloon 160*b* of the extendable tube 150 is reached in the bore well during the excavation. Wherein FIG. 1 B(c) shows extendable tube 150 from where air is removed from retaining balloons 160*a*, 160*b* and 160*c* and the victim is reached in the bore well during the excavation operation.

Figure 2A:
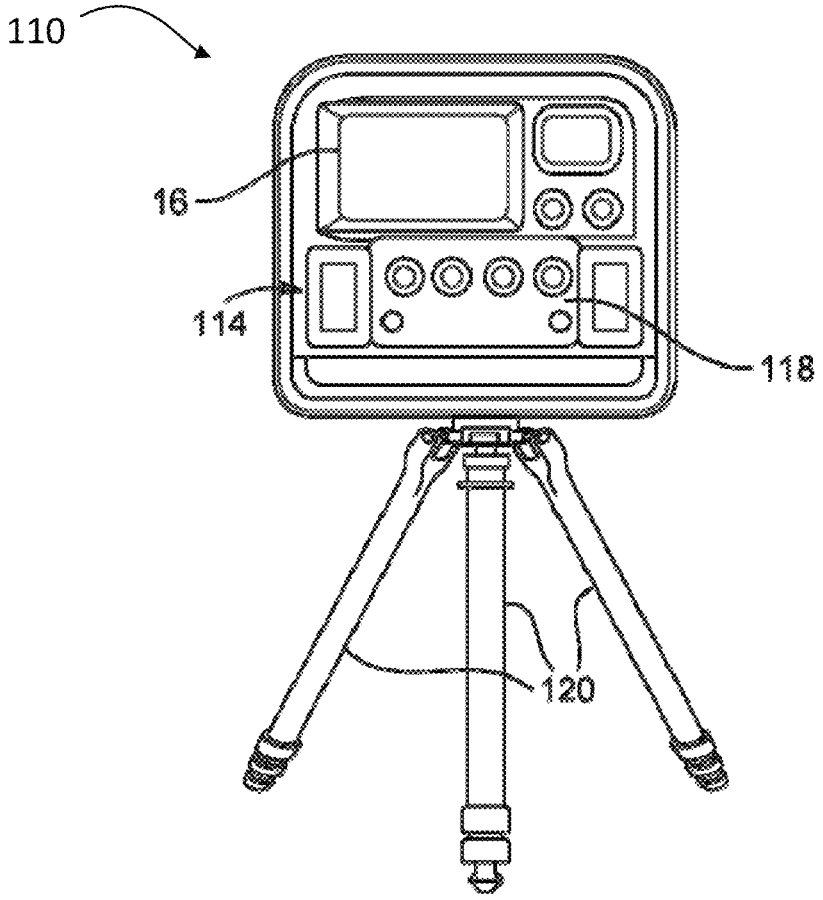
FIG. 2A is an exemplary illustration of a controller (Dashboard: central command center) of the well rescue and support system, according to certain embodiments.

Referring to FIG. 2A, shows the physical structure and physical features of the controller 110. the controller 110 comprises at least three legs 120 disposed at a bottom end of the controller 110, with each leg 120 comprising a flexible joint configured to collapse when the well rescue and support system 100 is not in use. The legs 120 are configured to stabilize the controller 110 on various ground surfaces during rescue operations, providing a stable platform for monitoring and control functions. The collapsible nature of the legs 120 enables compact storage and transport of the controller 110 between rescue operations while maintaining structural stability during deployment. The controller 110 is designed with durable materials and construction to withstand harsh environmental conditions encountered during rescue operations while maintaining reliable performance of all monitoring and control functions. In some embodiments, the controller comprises at least one of a wood, a metal, or a plastic. Suitable woods for manufacture of the controller include teak, *robinia*, bamboo, cypress, cedar, pine, fir, and the like. Suitable metals used to manufacture the controller may include aluminum, steel, and stainless steel. Suitable plastics for manufacture of the controller may be a resin, high-density polyethylene (HDPE), polyethylene (PE), polypropylene, and polycarbonate.

In an embodiment, the dashboard 114 of the controller 110 is configured to enable operators of the system to monitor and manage operations through an interface, with such interface being provided by the screen 116. The processor of the controller 110 is configured to record both qualitative and quantitative data through the dashboard 114, which can be utilized for determining effectiveness of services provided during current and future rescue operations. The dashboard 114 may incorporate pressure gauges for monitoring oxygen supply levels and pressure readings from multiple sensors throughout the well rescue and support system 100. The screen 116 of the dashboard 114 is configured to display real-time pressure readings, oxygen flow rates, and video feed received from the communication head. The screen may be a physical screen or a touch screen. In an embodiment, the screen 116 is at least one selected from the group consisting of a liquid-crystal display (LCD) screen, a light-emitting diode (LED) screen, and an organic light-emitting diode (OLED) screen. The exact screen type may be selected based on the operational requirements. In a preferred embodiment, the screen 116 is an LCD screen. The keypad 118 of the dashboard 114 may comprise physical buttons (e.g. a keyboard) or touch screen buttons enabling operation for the well rescue and support system 100. The interface of the dashboard 114 is designed for intuitive operation during high-pressure rescue scenarios. For purposes of the well rescue and support system 100, the keypad 118 may be provided with override capabilities for emergency situations.

Figure 2B:
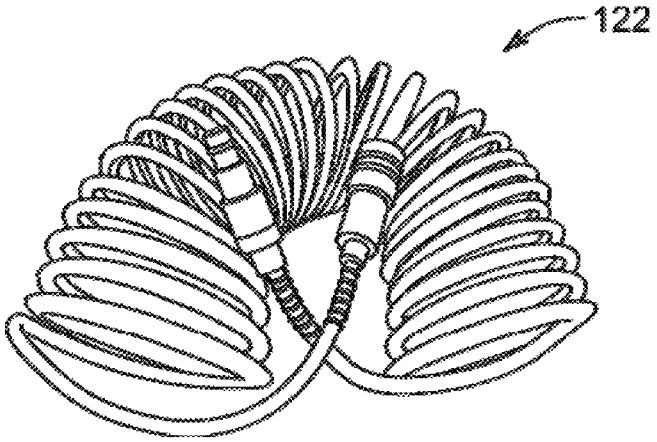
FIG. 2B is an exemplary illustration of a coaxial cable configured to be implemented with the controller of the well rescue and support system, according to certain embodiments.

FIG. 2B illustrates an exemplary depiction of a coaxial cable 122, according to certain embodiments. In the well rescue and support system 100, the controller 110 is configured to manage signal transmission through the coaxial cable 122 or any other information transfer medium 145 that enables transmission of operational data, video feeds, and control signals throughout the well rescue and support system 100. The controller 110 is configured to maintain records of all operational parameters through the dashboard 114, including pressure readings, oxygen flow rates, and system status indicators. These records enable rescue personnel to analyze rescue operations and improve procedures for future use. The control module 600 in the controller 110 may also incorporate automated alerts on the dashboard 114 for monitoring oxygen depletion, pressure anomalies, or communication loss, ensuring continuous awareness of status of the well rescue and support system 100 during rescue operations.

The compressed gas output valve 112 or any other such similar device of the controller 110 is configured to regulate gas flow to various components of the well rescue and support system 100. The controller 110 manages gas distribution through multiple channels, enabling simultaneous supply of gas for balloon inflation and oxygen delivery to trapped individual. The execution module 800 of the controller 110 contains instructions to monitor and adjust gas flow rates through the compressed gas output valve 112 based on real-time pressure readings and oxygen requirements. The gas flow regulation through the compressed gas output valve 112 is controlled to maintain optimal pressure levels throughout the rescue operation.

Figure 2C:
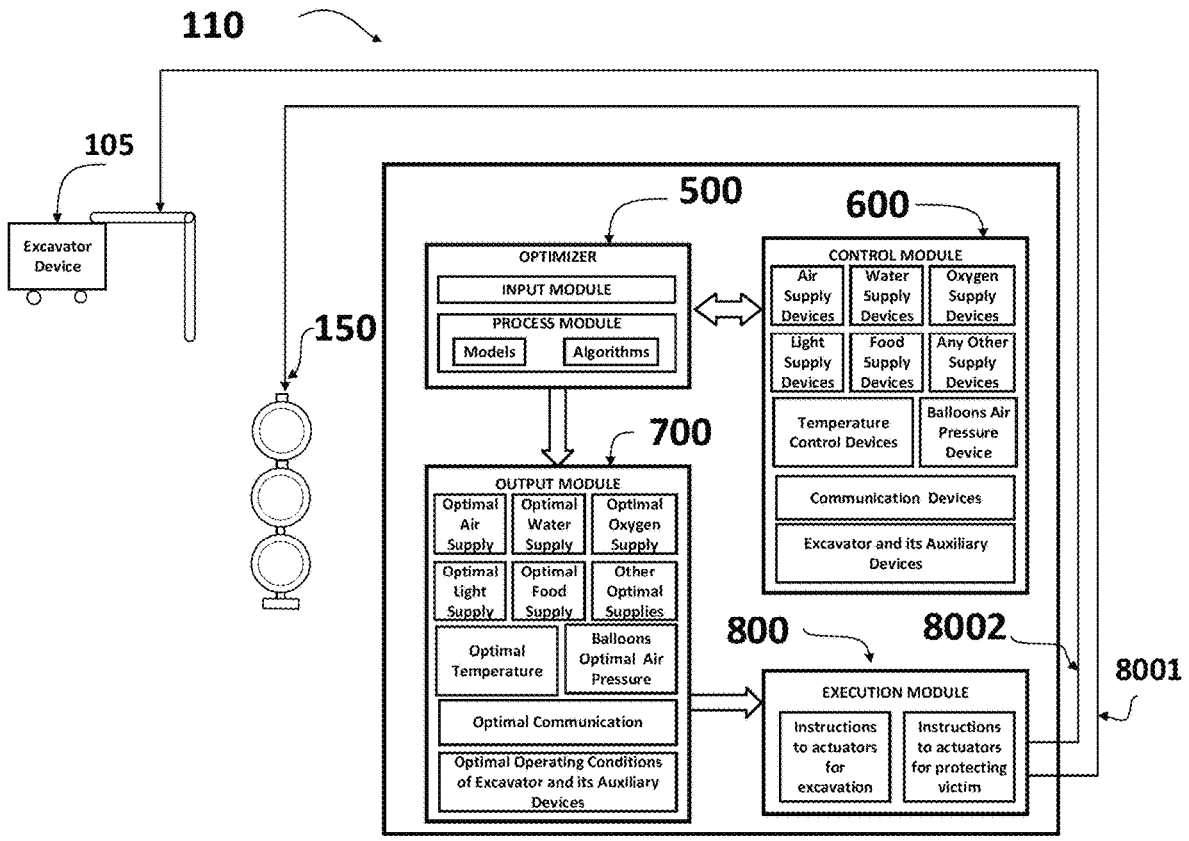
FIG. 2C is an exemplary illustration of controller of the present disclosure in accordance with the other embodiments.

FIG. 2C illustrates the details of controller 110 and transfer of information from execution module 800 to control the actuators installed on excavation device 105 and extendable tube 150.

Figure 3A:
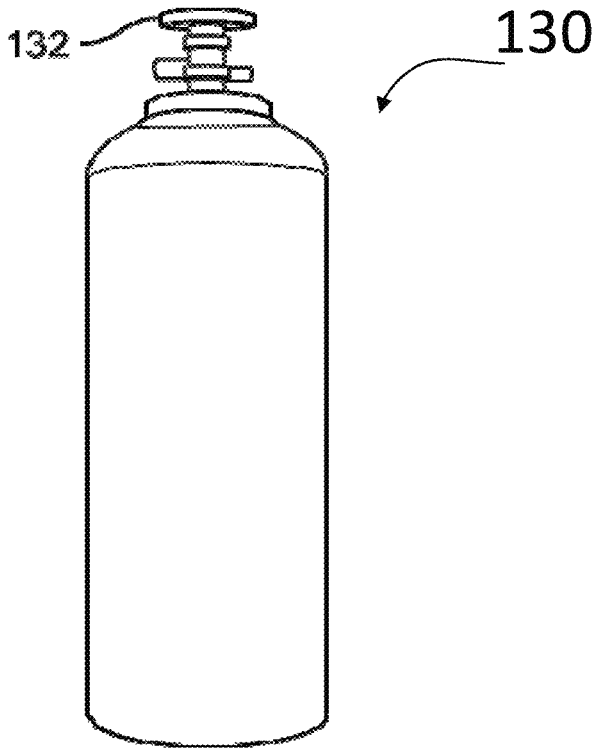
FIG. 3A is an exemplary illustration of a compressed air tank of the well rescue and support system, according to certain embodiments.

As illustrated in FIG. 1A, the well rescue and support system 100 comprises a compressed air tank 130 configured to provide gas supply for both stabilization and life support functions. FIG. 3A illustrates an exemplary depiction of the compressed air tank 130. As depicted in FIG. 3A, the compressed air tank 130 comprises a regulator 132 that controls the gas pressure and flow rates from the compressed air tank 130 to other components of the well rescue and support system 100. For present purposes, the regulator 132 may include multiple monitoring gauges and pressure adjustment mechanisms to ensure precise control over gas delivery. The regulator 132 of the compressed air tank 130 is configured to maintain pressure levels suitable for both oxygen supply to trapped individuals as well as balloon inflation operations.

Figure 3B:
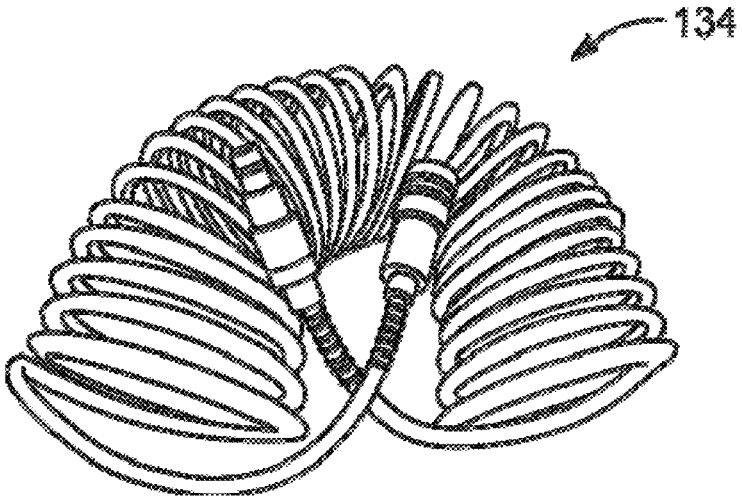
FIG. 3B is an exemplary illustration of a first tube configured to be implemented with the compressed air tank of the well rescue and support system, according to certain embodiments.

FIG. 3B illustrates an exemplary depiction of a first tube 134 associated with the compressed air tank 130. As shown in FIG. 1, the regulator 132 is connected to the compressed gas output valve 112 of the controller 110 through the first tube 134, enabling controlled gas distribution throughout the well rescue and support system 100. The first tube 134 connecting the regulator 132 to the compressed gas output valve 112 is designed to withstand high-pressure gas flow while maintaining flexibility for operational deployment. The connection between the regulator 132 and the compressed gas output valve 112 through the first tube 134 incorporates sealed fittings to prevent gas leakage during operation. The compressed air tank 130 is sized to provide sufficient gas capacity for extended rescue operations, with the ability to refill or replace the compressed air tank 130 as needed during prolonged rescue efforts. The regulator 132 comprises built-in safety mechanisms including pressure relief valves and automatic cutoff features to prevent overpressurization. The compressed air tank 130 is positioned adjacent to the controller 110 during operation to enable easy monitoring and adjustment of the regulator 132 by rescue personnel. The first tube 134 is constructed with pressure-resistant materials capable of maintaining structural integrity under varying gas flow conditions. The regulator 132 works in coordination with the processor of the controller 110 to maintain optimal gas pressure levels throughout rescue operations.

Figure 4:
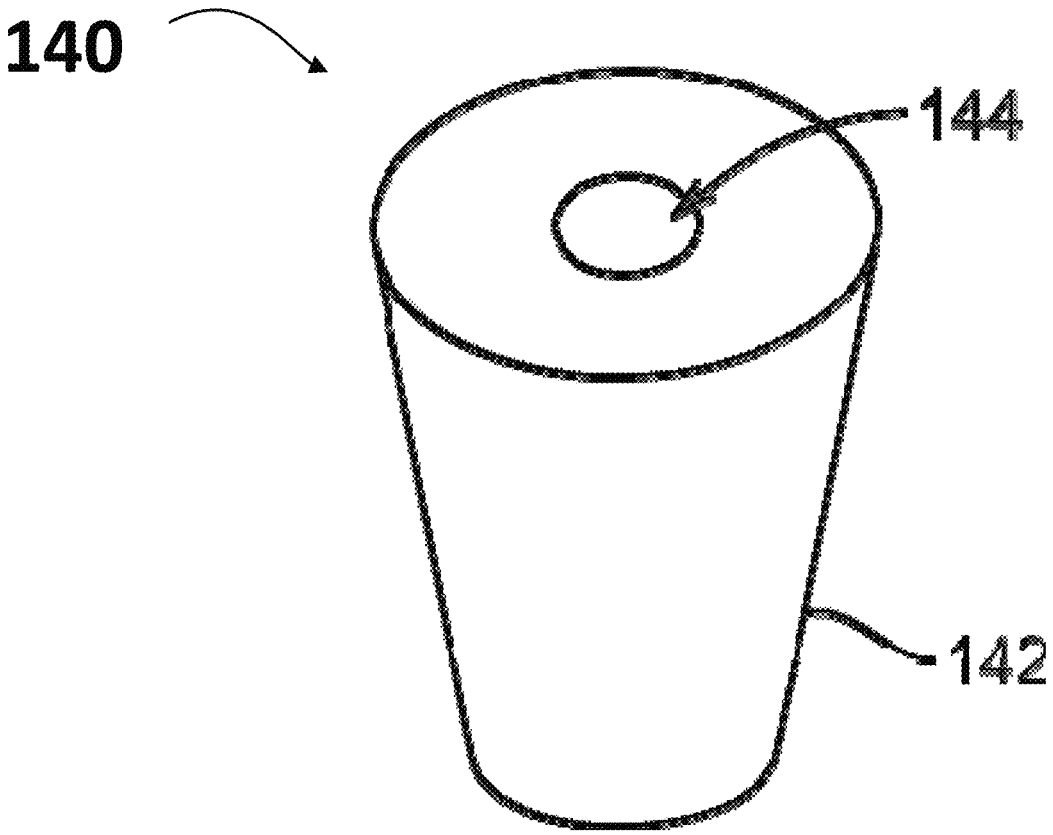
FIG. 4 is an exemplary illustration of a well cap of the well rescue and support system, e.g., a solid conical body having an axial passage, according to certain embodiments.

Referring to FIG. 1A, as illustrated, the well rescue and support system 100 comprises a well cap 140 configured to fill an opening of a well to prevent additional debris from entering the well during rescue operations. FIG. 4 illustrates an exemplary depiction of the well cap 140. As illustrated in FIG. 4, the well cap 140 comprises a solid conical body 142 with an axial passage (e.g., passage) 144 through which rescue equipment passes. The well cap 140 is designed to provide support for components of the well rescue and support system 100 while maintaining a secure seal around the well opening. The solid conical body 142 of the well cap 140 is configured to accommodate wells of varying diameters while maintaining structural integrity during rescue operations. The axial passage 144 in the well cap 140 is sized to allow passage of system components while preventing debris from falling into the well. The solid conical body 142 is designed with sufficient mass and structural support to maintain position during rescue operations while the axial passage 144 provides guided passage for rescue equipment. The surface of the solid conical body 142 may comprise textured patterns to enhance grip and prevent slippage during deployment. The axial passage 144 may also incorporate reinforced edges to prevent wear from repeated equipment passage. The well cap 140 serves as a stabilizing platform for the equipment of the well rescue and support system 100 during deployment. The well cap 140 creates an effective barrier between the well environment and the surface, enabling controlled management of the rescue operation environment. The well cap 140 is designed for rapid deployment while ensuring secure positioning throughout rescue operations. It prevents soil and stones from falling on the retaining balloons during the excavation operation. The materials selected for the well cap 140 provide flexibility for conforming to irregular well openings while maintaining necessary rigidity for supporting rescue equipment. In an embodiment, the well cap 140 comprises at least one flexible material selected from the group consisting of a silicone, rubber, cork, and polyurethane. The material selection for the well cap 140 enables the well cap 140 to conform to irregular well openings while maintaining structural integrity. The flexible material properties allow the well cap 140 to create an effective seal against the well opening while accommodating the passage of rescue equipment through the axial passage 144. The flexibility of these materials also enables the well cap 140 to absorb operational vibrations and movements during rescue procedures while maintaining its position for proper operation of the well rescue and support system 100. In a preferred embodiment, the well cap 140 comprises cork. The cork construction of the well cap 140 provides natural compression properties that enhance the seal between the well cap 140 and the well opening, while maintaining sufficient rigidity to support the weight of rescue equipment. The cork material also offers resistance to environmental degradation and maintains consistent performance across a range of temperatures and moisture conditions encountered during rescue operations.

As illustrated in FIG. 1A, the well rescue and support system 100 comprises an extendable tube 150 configured to pass from the dashboard 114 through the axial passage 144 of the solid conical body 142 of the well cap 140. As illustrated in FIG. 1A, the extendable tube 150 is fluidly connected to the compressed air tank 130 through the compressed gas output valve 112, enabling gas flow throughout the length of the extendable tube 150. In some examples, the extendable tube 150 may be designed with length adjustment mechanisms to accommodate wells of varying depths while maintaining stable connections to both the controller 110 and other system components. The extendable tube 150 comprises a controller end 152 that connects directly to the controller 110, ensuring secure transmission of both gas and control signals. The controller end 152 of the extendable tube 150 may incorporate sealed connections for both gas delivery and electrical signal transmission.

Figure 5:
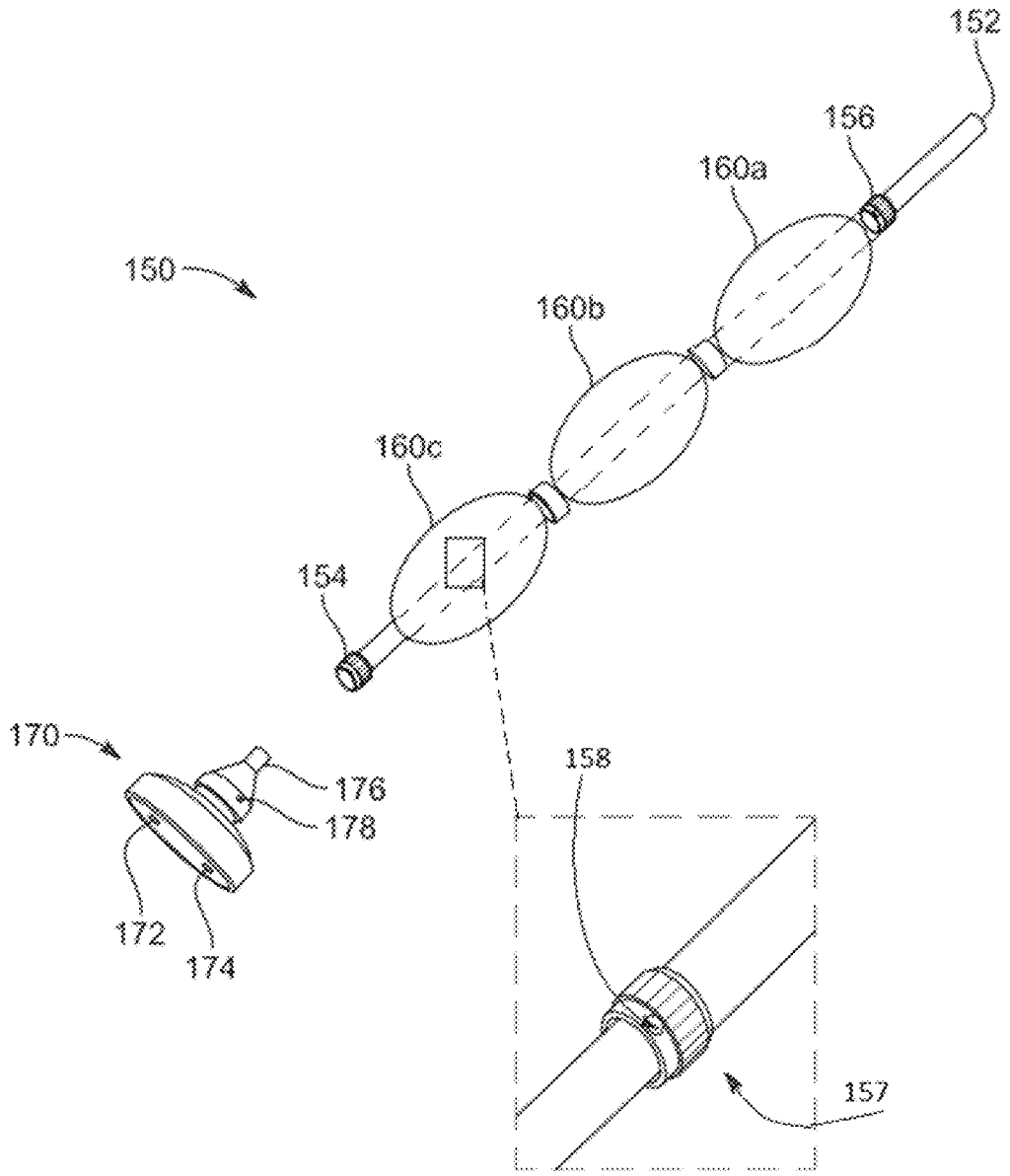
FIG. 5 is an exemplary illustration of an assembly showing an extendable tube supporting at least one retaining balloon and a communication head of the well rescue and support system, according to certain embodiments.

FIG. 5 illustrates an exemplary depiction of the extendable tube 150. The extendable tube 150 is constructed to house multiple internal channels that facilitate communication of various type of sensors 172 and actuators 174 which are installed on the communication head of the extendable tube for simultaneous transmission of information and supplies which are needed by the victim in the bore well including gas, electrical signals, and control wiring throughout the well rescue and support system 100. In an embodiment, the extendable tube 150 is formed from at least one selected from the group consisting of polyvinyl chloride (PVC), stainless steel, aluminum, and carbon steel. In a preferred embodiment, the extendable tube 150 is formed from aluminum. In some embodiments, the extendable tube 150 incorporates flexible joints at regular intervals to enable navigation through irregular well structures while maintaining internal channel integrity. The extendable tube 150 may also comprise reinforced walls to prevent collapse under pressure while preserving flexibility required for deployment in varied well conditions. Further, the connection points along the extendable tube 150 may be configured to prevent gas leakage and maintain signal integrity throughout rescue operations, the extendable tube passes through all retaining balloons 160*a*, 160*b* and 160*c* wherein extendable tube contains control valve 157 and an opening for air 158 which are used to control the flow of air in the retaining balloons in accordance with the excavation process and air flow into and out of the retaining balloons presented in FIG. 1C Referring to FIG. 1A and FIG. 5, as illustrated, the well rescue and support system 100 comprises at least one retaining balloon disposed around the extendable tube 150 and along an axis of the extendable tube 150. In the accompanied exemplary illustrations, the well rescue and support system 100 is depicted to comprise three retaining balloons 160*a*, 160*b* and 160*c*. The retaining balloons 160*a-c* are positioned proximal to a well end 154 of the extendable tube 150, with specific spacing between each retaining balloon to provide optimal wall support coverage. In some embodiments, the spacing between each retaining balloon is the same or different. In another embodiment, the spacing between each retaining balloon is customizable, the retaining balloons being adjustable along the extendable tube to suit wall support for several different well formations. Each retaining balloon 160*a-c* is configured to independently inflate and deflate to accommodate varying well diameters and bore well wall conditions. The retaining balloons 160*a-c* are designed to apply uniform pressure against well walls when inflated, preventing collapse during rescue operations. Each retaining balloon comprises an inflation valve and a deflation valve configured to control the volume of gas therein. In an embodiment, each retaining balloon 160*a-c* is formed from at least one elastomeric material selected from the group consisting of a rubber, a polyurethane, a polybutadiene, a polychloroprene, and a silicone. In a preferred embodiment, each retaining balloon 160*a-c* is formed of a polyurethane. The elastomeric material enables controlled expansion of the retaining balloons 160*a-c* while maintaining structural integrity under pressure.

In a preferable embodiment, the balloons are configured with a channel permitting passage of gas or fluid around the bone balloons. For example, gas (air) may be injected below the lowest balloon, for example gas injected through the extendable tube, and pass upwards through the well passing around the balloons through the channels and exit through the well cap. The retaining balloons may be configured to permit air passage by including a longitudinal groove (channel) such as a longitudinal depression along the entire axial length of the outer surface of the balloon that is in contact with a wall of the well. The groove or depression is preferably shallow and has a depth of less than 20% of the radius, preferably less than 15%, of the radius of the balloon. Further, the groove or depression preferably has a narrow width, preferably representing a widest width at the outermost surface of the balloon that is 10° or less, and preferably less than 5° but greater than 1° of arc radius.

Further, the modular configuration of the retaining balloons 160*a-c* allows for individual control and monitoring of pressure levels at different depths within the well structure. Each retaining balloon 160*a-c* can be individually inflated to different target volumes based on local well conditions and structural requirements which are obtained from sensors 172 installed on the communication head of the extendable tule through communication medium 145. The positioning of multiple retaining balloons along the well end 154 of the extendable tube 150 enables the well rescue and support system 100 to maintain stable wall support even if individual balloons experience pressure changes. The retaining balloons 160*a-c* are securely attached to the extendable tube 150 through reinforced mounting points that prevent displacement during inflation and deflation cycles. In present embodiments, each retaining balloon 160*a-c* has a pressure sensor (not shown in accompanied drawings) configured to detect a pressure within the retaining balloon and communicate pressure data to the controller 110. The pressure sensors are integrated into the valve assembly of each retaining balloon 160*a-c*, generating continuous pressure data measurements from within each balloon volume. The pressure sensors are designed to detect pressure variations across the full operational range required for well wall stabilization, transmitting this data to the controller 110 through electrical connections housed within the extendable tube 150. Further, the controller 110 comprises a pressure monitor that receives and processes pressure data from the pressure sensors of each retaining balloon 160*a-c*. The pressure monitor in the controller 110 is configured to display real-time pressure readings on the screen 116 of the dashboard 114, enabling rescue personnel to continuously monitor the status of each retaining balloon. In some examples, the pressure monitor may be configured with threshold detection capabilities for identifying pressure variations that require adjustment during rescue operations. During operation of the well rescue and support system 100, the pressure sensors in the retaining balloons 160*a-c* work in conjunction with the pressure monitor and pressure control devices in the control module 600 of the controller 110 to maintain optimal wall support pressure. When the pressure sensors detect pressure changes within any retaining balloon, this data is immediately communicated to the pressure monitor, which processes the information and displays relevant alerts on the dashboard 114. The controller 110 utilizes this pressure data to automatically adjust gas flow through the compressed gas output valve 112, maintaining target pressure levels in each retaining balloon 160*a-c* throughout rescue operations.

In FIG. 1A, FIG. 1B and FIG. 5, as illustrated, the well rescue and support system 100 comprises a communication head 170 attached to a retaining balloon end 156 of the extendable tube 150. The communication head 170 comprises duality of sensors including but not limited to pressure sensors, oxygen measuring sensors, light intensity measuring sensors, microphone and other sensors used to measure values of variables which can influence on the comfort of the victim in bore well. The communication head 170 further comprises of duality of actuators 174, including but not limited to oxygen supply valves, air supply valves, lights, heaters etc to provide optimal values of the supplies of various supplies which are required for comfort of victim. The communication head 170 is configured to provide both audio and visual contact with trapped individuals while maintaining a connection to the well rescue and support system 100 through the extendable tube 150. The communication head 170 is mounted to the retaining balloon end 156 of the extendable tube 150. The positioning of the communication head 170 at the balloon end 156 enables improved placement of the communication head relative to trapped individuals while allowing coordinated operation with the retaining balloons 160*a-c*. In an embodiment, the communication head 170 comprises sealed housings for sensors 172 and actuators 174 including but not limited to the microphone, the camera, and the speaker and all kind of sensors and actuators to protect against environmental conditions encountered within the well formation. The actuators 174 including but not limited to microphone and the speaker of the communication head 170 are configured to provide clear two-way audio communication between rescue personnel and trapped individuals. The camera 174 is configured to capture high-quality visual data in low-light conditions. In some examples, the camera 174 is an infrared camera configured to capture images inside the well. The control wire 176 or any other data communication medium 145 connects the communication components of the communication head 170 to the optimizer 500 of the controller 110 and the dashboard 114 of the controller 110, enabling transmission of audio, visual, and control signals throughout the well rescue and support system 100. The coaxial cable 122 of the well rescue and support system 100 is disposed inside the extendable tube 150, providing signal transmission path between the communication head 170 and the controller 110. The coaxial cable 122 is configured to carry a visual and an audio signal received from the communication head 170 to the control dashboard 114. Further, in turn, the dashboard 114 is configured to display the visual signal on the screen 116. Herein, the coaxial cable 122 carries audio signals from the actuator 174 including microphone or any other device to carry audio signals, visual data from the camera or any other device for visual data, and control signals through the control wire 176, maintaining signal integrity throughout the length of the extendable tube 150.

In some embodiments, the communication head 170 further comprises a pressure sensor configured to detect changes in pressure within the well environment during operation of the well rescue and support system 100. The pressure sensor in the communication head 170 operates independently from the pressure sensors in the retaining balloons 160*a-c*, providing additional environmental monitoring capabilities at the location closest to trapped individuals. The pressure data from the communication head 170 is transmitted to the controller 110 through the control wire 176 or any other information sharing medium 8002, enabling real-time monitoring of well conditions near trapped individuals during rescue operations. In one embodiment, the pressure sensor of the communication head is configured to maintain a pressure level of at least 0.25 to 3 atmospheres (atm), preferably 0.95 to 1.05 atm in the area in which the individual is trapped.

In the well rescue and support system 100, instructions from the execution module 800 controller 110 may include instructions for lowering the extendable tube 150 into the well and delivering an inflation signal or a deflation signal to a balloon valve located on each retaining balloon 160*a-c*. The balloon valve is configured to inflate or deflate the retaining balloon 160*a-c* within the well structure to a target volume and thereby apply desired level of optimal pressure on a wall of the well to prevent the well from collapsing. The optimizer 500 is further programmed to determine optimal value of the lowering of the extendable tube 150 into the well through movement commands, while simultaneously monitoring feedback from the communication head 170 and pressure sensors to ensure proper positioning. The instructions from execution module 8—enable the controller 110 to coordinate the lowering speed and position of the extendable tube 150 based on real-time data received from V-data module. The processor in the controller 110 also comprises instructions for delivering inflation and deflation signals to the balloon valves located on each retaining balloon 160*a-c*. These signals are transmitted through the control wire 176 or any other information sharing medium 8002 and the coaxial cable 122 to the respective balloon valves, enabling precise control of gas flow into and out of each retaining balloon 160*a-c*. The instructions incorporate pressure monitoring data from the pressure sensors to determine appropriate inflation levels for each retaining balloon 160*a-c*, adjusting gas flow through the compressed gas output valve 112 to achieve target volumes. The instructions from execution module 800 ensure that each retaining balloon 160*a-c* applies appropriate pressure against the well walls to prevent collapse during rescue operations. The optimizer 110 continuously monitors pressure readings and adjusts inflation levels through the balloon valves to maintain optimal wall support. When pressure variations are detected by the pressure sensors, the optimizer 500 determine optimal pressure and send this to output module 700 and control module 600 from where control module 600 initiate automatic adjustments to inflation or deflation rates by execution module 800, ensuring consistent pressure application throughout the rescue operation. The controller 110 maintains records of all pressure adjustments and system responses, enabling analysis of system performance for future rescue operations.

Referring to FIG. 5, each retaining balloon 160*a-c* is configured to receive a separate amount of oxygen through each balloon valve 157 to inflate each retaining balloon to a target volume which is calculated in optimizer 500 and the respective supply of oxygen trough control module 600 and instructions of execution module 800 through any kind of communication medium 8002. This configuration enables independent control of inflation levels for each retaining balloon 160*a-c*. The compressed gas output valve 112 of the controller 110 is configured to distribute varying amounts of oxygen to each retaining balloon 160*a-c* based on specific pressure requirements at different depths within the well as calculated in the optimizer 500. Each retaining balloon 160*a-c* is configured to individually inflate to a different target volume, allowing the well rescue and support system 100 to accommodate irregular well shapes and varying wall conditions along the depth of the well. This independent inflation capability enables the retaining balloons 160*a-c* to maintain optimal wall support pressure while adapting to local structural variations within the well environment.

In some embodiments, the well rescue and support system 100 comprises a gas delivery tube 134 fluidly connected to the compressed air tank 130 through the controller 110. The gas delivery tube 134 is configured separately from the inflation channels for the retaining balloons 160*a-c*, dedicated specifically for delivering oxygen gas to trapped individuals. The execution module 800 of the controller 110 comprises instructions to provide a continuous flow of gas from the compressed gas tank 130 to a nozzle located at a distal end of the communication head 170. That is, optimizer 500 in the controller 110 comprises programmed instructions to calculate optimal values of the gas flow required in the bore well for trapped individual and send this information to the control module 600 and output module from where it is executed by execution module 800 to regulate and provide a continuous flow of gas from the compressed air tank 130 through the gas delivery tube to a nozzle located at the distal end of the communication head 170. The gas delivery tube runs through the interior of the extendable tube 150 alongside the coaxial cable 122, maintaining separation from balloon inflation channels while enabling consistent gas delivery throughout rescue operations. The continuous flow of gas passes through the gas delivery tube to the nozzle located at the distal end of the communication head, providing the oxygen gas to the trapped individual. In an embodiment, the continuous flow of the gas is delivered to the nozzle at a flow rate of 5 to 12 L/min air or 0.5 to 1 L/min oxygen. The continuous flow of gas through the gas delivery tube to the nozzle of the communication head 170 is controlled by the control module 600 in the controller 110 to maintain the desired controlled flow rate. This controlled flow rate ensures adequate oxygen supply for trapped individuals while preventing excessive pressure buildup within the well environment. The flow rate is monitored through sensors in the gas delivery tube and can be adjusted through the compressed gas output valve 112 based on environmental conditions and requirements detected by the sensor in the communication head 170. In another embodiment, the regulator of the compressed air tank is configured to maintain an oxygen supply of 15 to 25%, preferably 20 to 22%, in an area in which the individual is trapped.

Further, in some embodiments, the well rescue and support system 100 comprises at least one shore protection structure located along the extendable tube 150. The shore protection structure is configured to strengthen soil located along the new wall of the excavated well structure. The shore protection structure works to enhance well stability. The shore protection structure is positioned at strategic points along the extendable tube 150 to provide additional reinforcement to soil structures along the well walls. The shore protection structure is configured to strengthen potentially weak or unstable soil sections encountered during rescue operations, complementing the stabilization provided by the retaining balloons 160*a-c*. The shore protection structure functions as a supplementary support mechanism, working alongside the primary stabilization systems of the well rescue and support system 100 to ensure complete well wall reinforcement during rescue operations.

Figure 6:
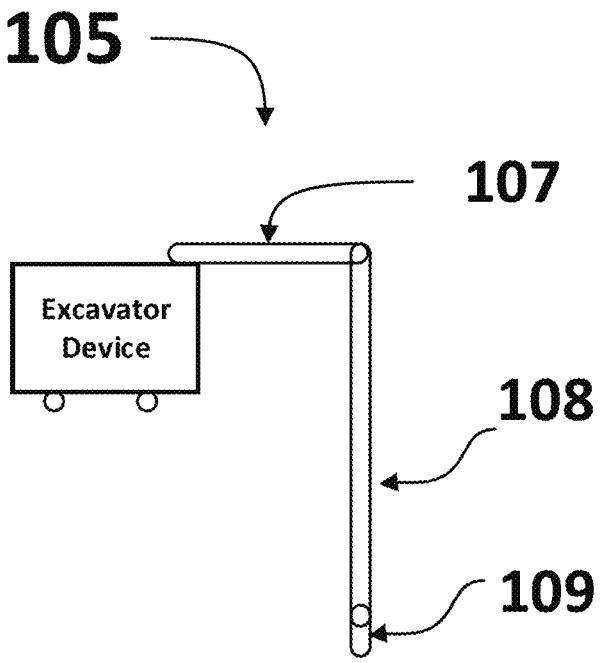
FIG. 6 is an exemplary schematic representation of an excavation device with sensors installed on in accordance with the other embodiments of the present invention

During operation of the well rescue and support system 100, deployment begins with positioning the controller 110 and compressed air tank 130 at the well site. The legs 120 of the controller 110 are extended and locked to provide stable support on the ground surface. The well cap 140 is installed over the well opening, with the solid conical body 142 creating a secure seal while the axial passage 144 enables passage of rescue equipment. The extendable tube 150 is passed through the axial passage 144 of the well cap 140 and gradually lowered into the well under control of the processor in the controller 110. The retaining balloons 160*a-c* enter the well in a deflated state, positioned at predetermined intervals along the well end 154 of the extendable tube 150. The communication head 170 at the balloon end 156 of the extendable tube 150 is positioned to establish visual and audio contact with trapped individuals. Once the extendable tube 150 reaches the required depth, the processor in the controller 110 initiates inflation of the retaining balloons 160*a-c* through the balloon valves. In some embodiments, the deflated retaining balloons are shifted once the extendable tube reaches the required depth. The deflated retaining balloons may be shifted to along irregular distances along the extendable tubes to provide support at specific portions of the wall along the depth of the well formation, depending on the stability of each well the system is used in. Once the retaining balloons are at a desired position along the extendable tube, each retaining balloon 160*a-c* is inflated to a target volume based on well conditions at different depths. The pressure sensors in each retaining balloon 160*a-c* continuously transmit pressure data to the pressure monitor in the controller 110, enabling real-time adjustment of inflation levels to maintain optimal wall support. A deployed well rescue and support system is depicted in FIG. 6. The gas delivery tube provides continuous oxygen flow to trapped individuals through the nozzle in the communication head 170 at controlled flow rates. The actuators 174 including microphone camera 174, and speaker in the communication head 170 enable constant communication between rescue personnel and trapped individuals. The sensor 172 including camera or any other device is utilized for visual monitoring of the rescue environment, with infrared capabilities for low-light conditions. The screen 116 of the dashboard 114 displays real-time system status comprising pressure readings, oxygen flow rates, and video feed from the communication head 170. The optimizer 500 in the controller 110 continuously monitors all operational parameters through the coaxial cable 122, adjusting gas flow and balloon pressure levels as needed and calculated in optimizer 500. The shore protection structures along the extendable tube 150 provide additional reinforcement to potentially unstable soil sections during the rescue operation. Throughout the rescue operation, the controller 110 maintains detailed records of all operational parameters including pressure levels, oxygen flow rates, and system responses. These records enable analysis of system performance and continuous improvement of rescue procedures. The automated alert system in the controller 110 provides immediate notification of any operational anomalies, enabling rapid response to changing conditions during rescue operations. The well rescue and support system 100 is configured for scalability across different well configurations. The dimensions, diameter, depth, and operational parameters of the well rescue and support system 100 can be modified based on specific well site conditions. The well rescue and support system 100 can be standardized or modified for various operations including deeper wells or wells requiring specific soil support configurations. The well rescue and support system 100 further comprises multiple monitoring systems for oxygen levels, pressure conditions, and communication status, with automated notifications for any operational anomalies.

FIG. 6 illustrates block diagram of an excavator device comprising of excavator arm 107, excavator rod 108 and excavator sensors 109. The excavator arm 107 and the excavator rod 108 are configured to adjust their position as per need of the excavation operation around the bore well. Their position and movement is controlled by excavator 105 as per instructions obtained from the excavation module 800 through information sharing medium 8001. The sensors 109 installed on the excavator rod are utilized to get real time data of the land, loading condition and excavation related data from the excavated land.

Figure 7A:
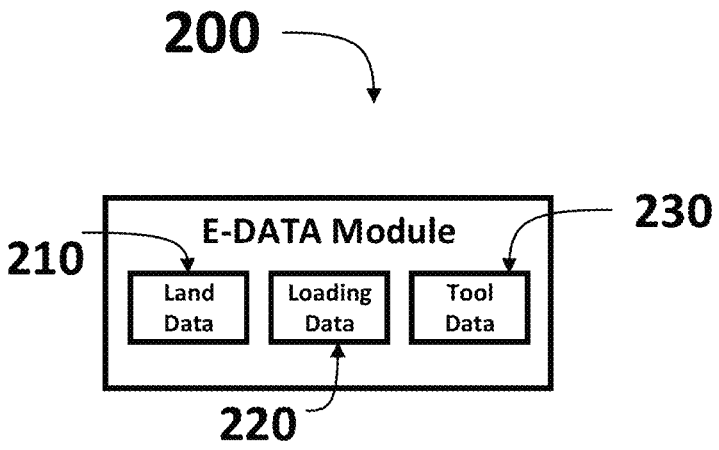
FIG. 7A is an illustration of E-data module in the disclosed subject matter in accordance with the other embodiments.

FIG. 7A illustrates block diagram of E-data module 200 containing data which is received from excavator 105. E-data module contains land data 210, loading data 220 of the excavator rod 108 and other related tool data 230. E-data module 200 is configured and utilized to receive all excavation related data from excavator 105 and store it and share it with optimizer 500 through any kind of information sharing medium 2001.

Figure 7B:
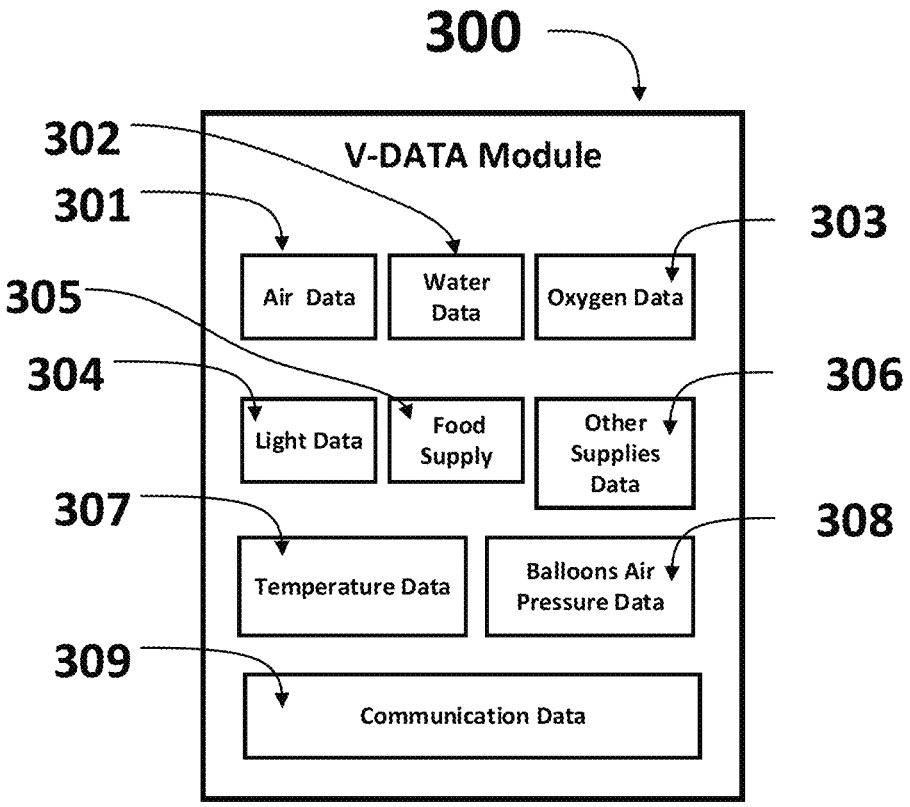
FIG. 7B is an illustration of V-data module in the disclosed subject matter in accordance with the other embodiments.

FIG. 7B illustrates the block diagram of V-data module 300. V-data module receives real time data of variables which can influence the life and comfort of the trapped victim. V-data module 300 contains air data 301 including but not limited to air quality data, air volume data, air composition data etc which is obtained from extendable tube 150 and measured from bore well through sensors 172 installed on the communication head 170 of the extendable tube 150. V-data module 300 contains water data 302 including but not limited to the data of water quality, water composition, cleanliness in the bore well where the victim is trapped in the bore well. V-data module 300 contains oxygen data 303 including but not limited to the quality of oxygen, its volume, expected shortage etc in the place in bore well where the victim is trapped. In addition, V-data module 300 contains real time light data 304 including but not limited to the intensity of light, its quality, etc in the bore well near the position of victim in the bore well. Furthermore, V-data module 300 contains real time food supply data 305 including but not limited to quality of food, need of food, quantity of food needed etc in the position of bore well where the victim is trapped. Moreover, V-data module contains data of any other kind of supplies 306 which can influence on the comfort and life of victim trapped in the bore well. Furthermore, V-data module 300 contains real time temperature data 307, real time retaining balloons air pressure data 308 which are installed on the extendable tube 150 and V-data module contains communication data 309 including but not limited the voice of victim, talks of victim, movements of victim etc.

Figure 8A:
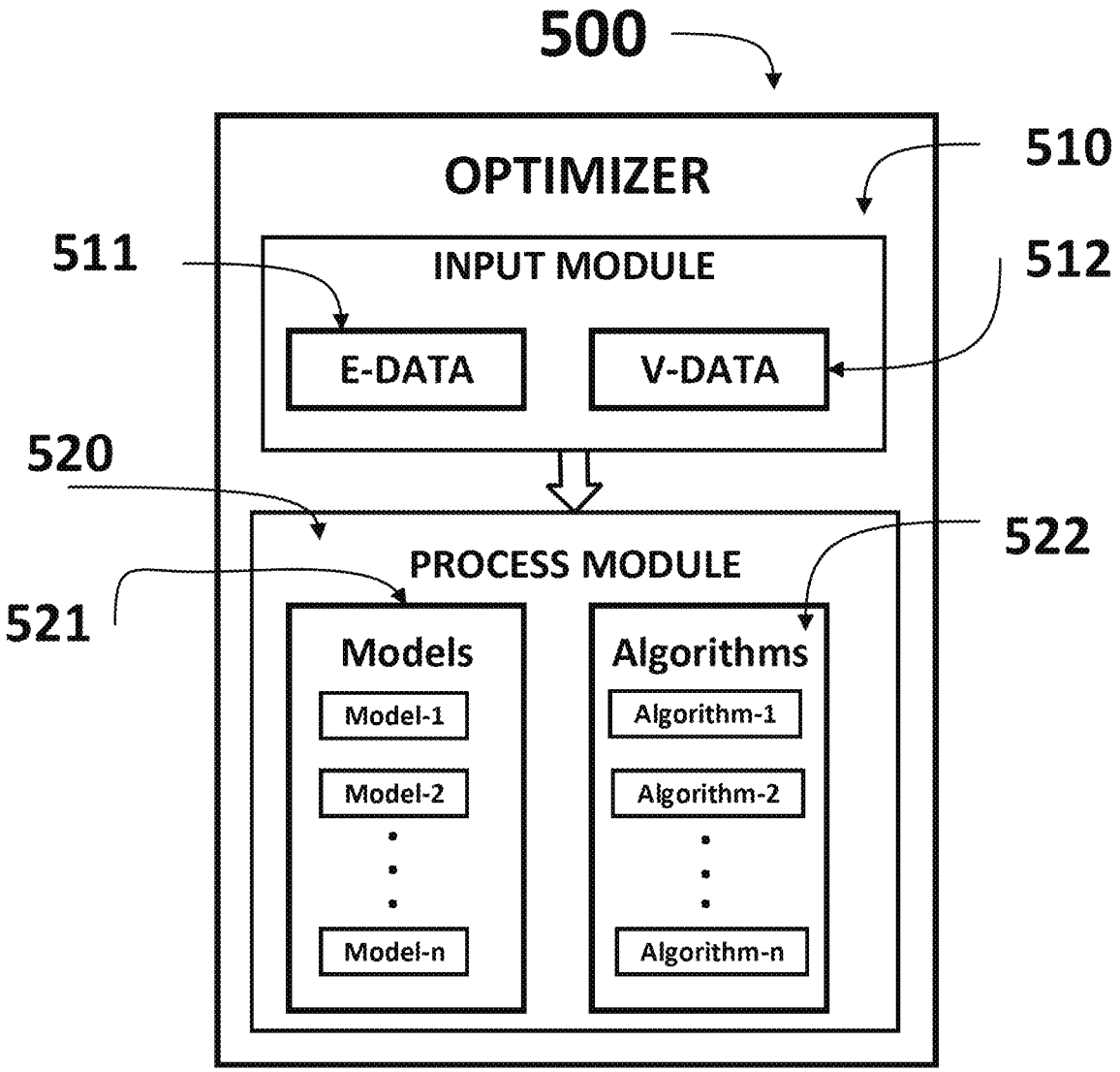
FIG. 8A is an exemplary schematic diagram of optimizer in accordance with the other embodiments.

FIG. 8A illustrates block diagram optimizer 500 comprises of input module 510 and process module 520. The input module 510 further comprises of E-Data 511 and V-Data 512; wherein E-Data 511 contains the data and information which is received by optimizer 500 from E-data module 200 through information sharing medium 2001. Similarly, V-Data 520 contains the data and information which is received by optimizer 500 from V-data module 300 through information sharing medium 3001. The input module 510 in the optimizer 500 filters E-data 511 and V-data 512 and transfers it to process module 520. The process module 520 comprises various models 521 and various algorithms 522 for calculation of various variables which can influence the excavation process and comfort of the trapped individual. The models are developed to calculate feasible values of the variables which are related to the optimal performance of excavation operation based on the real time E-data 511 and calculate feasible values of variable which are related to optimal conform and life of victim based on real time V-data 512. The models contains set of constraints and conditions which are related to the conditions of the real situation of excavator operation and the condition of victim trapped in the bore well and also contains the objective which is required to optimize for best performance of excavator operation and for the best comfort of the victim trapped in the bore well. The algorithms are developed to search for an optimal combination of values of all variables which can influence the performance of excavation operation and comfort and life of victim. Algorithms 522 contains set of decision making rules, intelligent search techniques or combination of these or any other type of optimization methods or their combination.

Figure 8B:
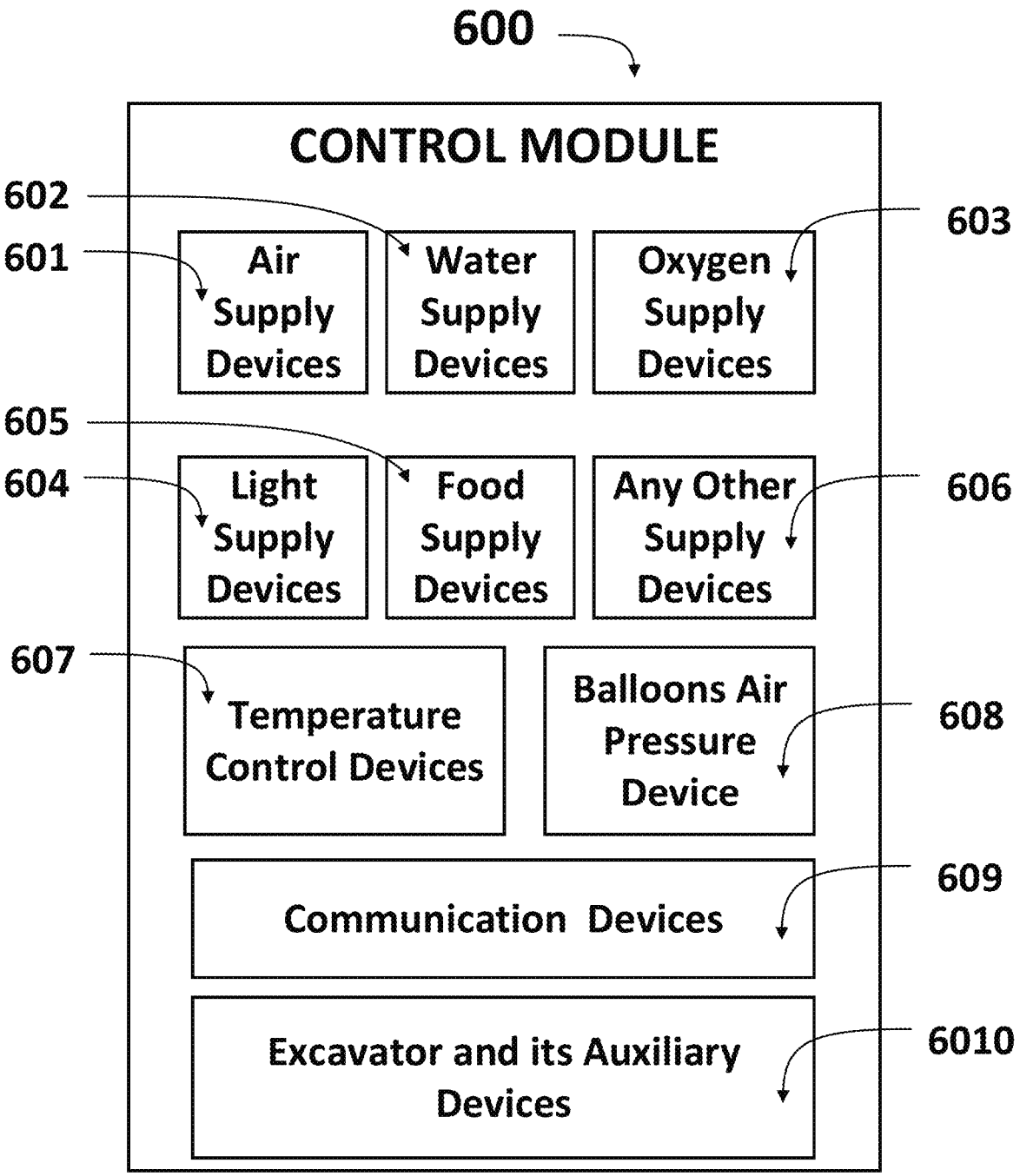
FIG. 8B is an exemplary schematic diagram of control module of the disclosed subject matter in accordance with the other embodiments.

FIG. 8B illustrates block diagram of control module 600 comprises of various devices which are installed in the system 100 including but not limited to air supply devices 601, water supply devices 6602, oxygen supply devices 603, light supply devices 604, food supply devices 605, any other supply devices 606, temperature control devices 607, balloon air pressure devices 608, any kind of communication devices 609, and excavator and its auxiliary devices 6010 etc. The devices in control module 600 are used to transfer information from these devices to optimizer 500 as well as get information from optimizer 500 to control these devices as per requirements in the excavation process.

Figure 8C:
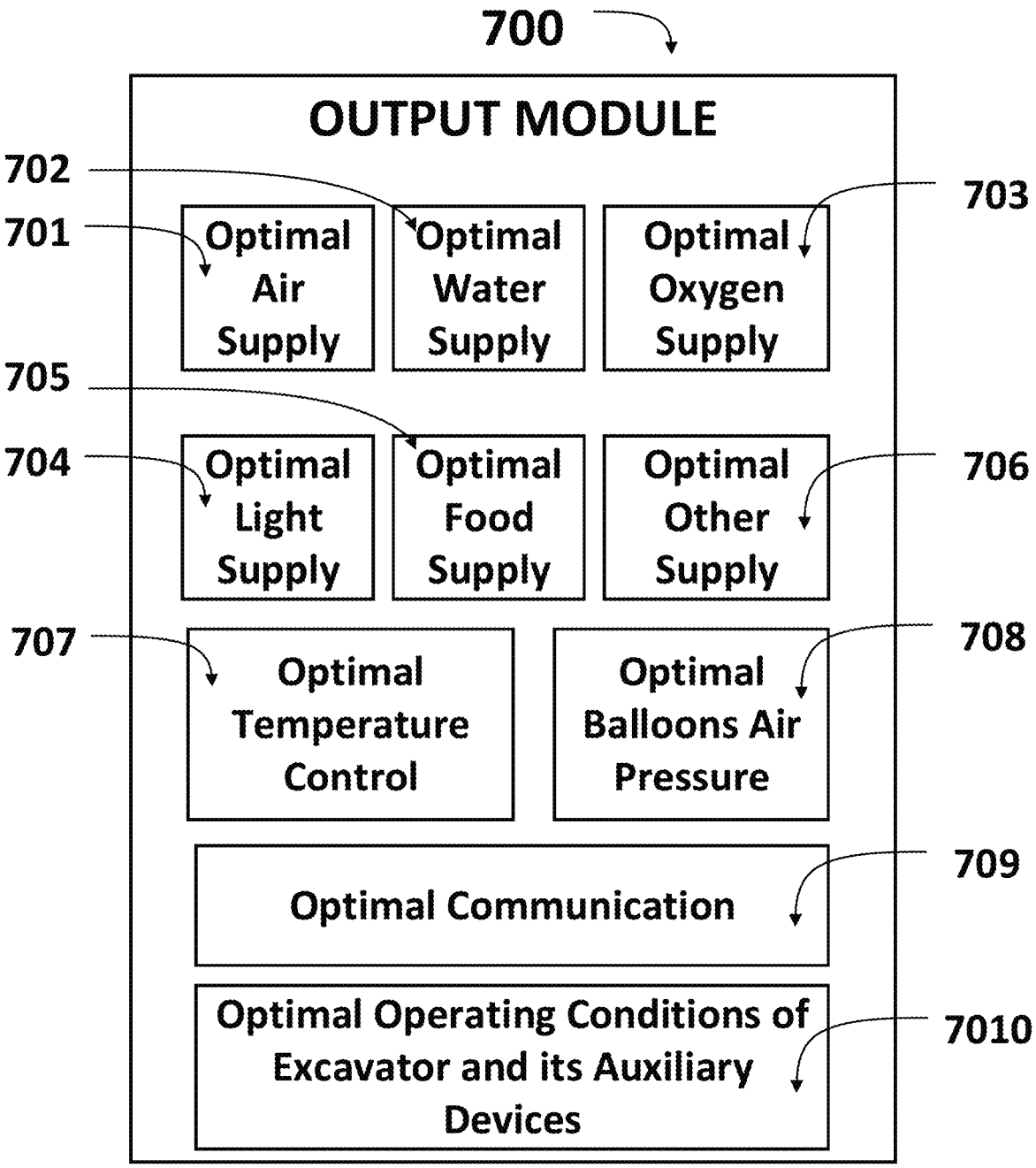
FIG. 8C is an exemplary schematic diagram of output module of the disclosed subject matter in accordance with the other embodiments.

FIG. 8C illustrates block diagram output module 700 to deliver optimal air supply 701, optimal water supply 702, optimal oxygen supply 703, optimal light supply 704, optimal food supply 705, optimal supply of other items 706, optimal supply of temperature and its control 707, optimal balloons air pressure 708, optimal communication 709, and optimal operating conditions of excavator and operating conditions of other auxiliary devices of excavators 7010. Output module 700 delivers optimal values of the variables to the execution module 800.

Figure 8D:
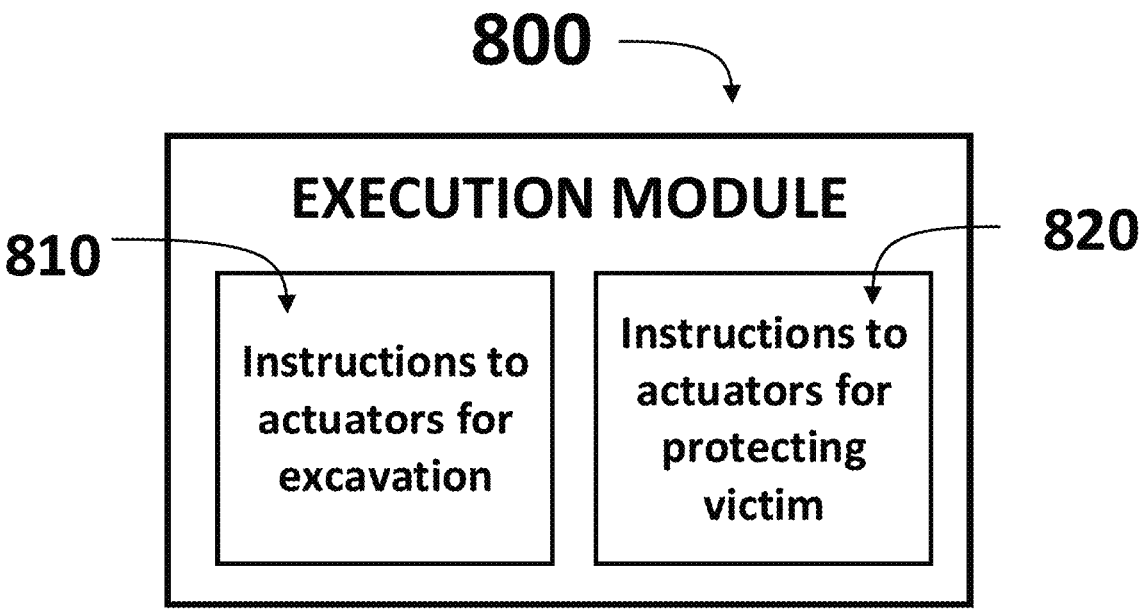
FIG. 8D is an exemplary schematic diagram of execution module of the disclosed subject matter in accordance with the other embodiments.

FIG. 8D illustrates block diagram of execution module 800 which is used to deliver execution commands and instructions to excavator device 105 for optimal excavation process through any kind of information sharing mechanism 8001 and optimal instructions to actuators 174 for protecting the victim through information sharing mechanism 8002. The optimal instructions for excavator device 105 perform excavation on optimal conditions include but not limited to operate excavator at optimal movement of the arm 107 and optimal movement of excavator rod 108. The optimal instructions to the actuators 174 for protecting victim through information sharing mechanism 8002 includes but not limited to supply air to the retaining balloons at optimal level in order to protect the victim from injury. Moreover, optimal instructions to the actuators 174 for protecting victim also include but not limited to the optimal supply of oxygen to the victim through optimal control of the actuator 132 installed on compressed air tank 130 which is controlling the supply of oxygen to the victim. The execution module 800 deliver instructions and commands to control movement of the excavator device 105 and also pass instructions to the actuators which are controlling all devices and actuators which are linked with the comfort and life of victim trapped in bore well.

The above-described hardware description is a non-limiting example of corresponding structure for performing the functionality described herein.

EMBODIMENTS

A well rescue and support system, comprising:

an excavation device for performing vertical excavation around the bore well, comprises of excavator arm, excavator rod and excavator sensors, a controller having an optimizer, output module, control module and execution module;

wherein the optimizer comprises of an input module and a process module;

wherein the input module receives the real time data from excavation process and real time data of all variables which can influence on the life and comfort of the trapped victim;

wherein the process module comprises models to calculate feasible values of variables which can affect on the excavation process and which can influence on the comfort of the trapped victim in bore well;

wherein the output module shows the optimal values of the variables which can influence on the comfort of the trapped victim and shows optimal values optimal operating conditions of the excavator device;

wherein the control module controls the devices and actuators installed in the well rescue system and operates the devices at the optimal operating conditions;

wherein the execution module comprises of instructions for excavation process and instructions to actuators for protecting and providing comfort to the victim in bore well;

a controller with program instructions, a compressed gas output valve and a dashboard having a screen and a keypad;

a compressed air tank having a regulator, the regulator connected to the compressed gas output valve of the controller by a first tube;

a well cap configured to fill an opening of a well, the well cap having a solid conical body with an axial passage;

an extendable tube passing from the dashboard through the axial passage of the solid conical body, the extendable tube fluidly connected to the compressed air tank through the output valve, wherein the extendable tube is connected to the controller at a controller end of the extendable tube;

at least three retaining balloons disposed around the extendable tube and along an axis of the extendable tube, wherein one of the retaining balloons is proximal to a well end of the extendable tube; and a communication head wherein;

multiple sensors are installed on the communication head to measure real time values of variables which can influence on the comfort of the trapped victim including but not limited to light sensor, microphone, air pressure sensor, oxygen measuring sensor etc and similar type of other kind of sensors which can detect the real time value of the variable influencing comfort of the trapped victim;

wherein multiple actuators are installed on the communication head to provide comfort to the trapped individual in the bore well including but not limited to oxygen supply valve, light, air flow valves, speaker, or any other type of actuators which can provide comfort to the trapped victim wherein a microphone, a camera, a control wire, and a speaker, the communication head attached to a balloon end of the extendable tube, wherein the control wire is electrically connected to the processor and the dashboard of the controller by a coaxial cable disposed inside the extendable tube, wherein the program instructions from execution module of the controller in the controller include instructions for optimally performing excavation operation through optimal movement of the excavation device as per instructions of the execution module;

wherein the execution module in the controller passes optimal instructions to all the actuators installed in the well rescue system including but not limited to oxygen supply, air supply, pressure controllers, light intensity controlling devices;

wherein the instructions from execution module deliver instructions for lowering the extendable tube into the well and delivering an inflation signal or a deflation signal to a balloon valve located on each retaining balloon, the balloon valve configured to inflate or deflate the retaining balloon within the well structure to a target volume and thereby apply a pressure on a wall of the well to prevent the well from collapsing.

The well rescue and support system wherein each retaining balloon is formed from at least one elastomeric material selected from the group consisting of a rubber, a polyurethane, a polybutadiene, a polychloroprene, and a silicone, and wherein each retaining balloon has a channel on an outer surface, the channel having a depth measured from the axis of the balloon of 80% or less a radius of the balloon, and wherein the balloons are staggered along the extendable tube such that the channels for neighboring balloons are not linearly aligned.

The well rescue and support system wherein each retaining balloon has a pressure sensor configured to detect a pressure within the retaining balloon and communicate pressure data to the controller.

The well rescue and support system wherein the coaxial cable is configured to carry a visual and an audio signal received from the communication head to the control dashboard, and wherein the dashboard is configured to display the visual signal on the screen.

The well rescue and support system wherein the screen is at least one selected from the group consisting of a liquid-crystal display (LCD) screen, a light-emitting diode (LED) screen, and an organic light-emitting diode (OLED) screen.

The well rescue and support system wherein each retaining balloon is formed of a polyurethane.

The well rescue and support system wherein the controller further comprises at least three legs disposed at a bottom end of the controller being attached to configured to stabilize the controller, wherein each leg comprises a flexible joint configured to collapse when the system is not in use.

The well rescue and support system wherein the controller further comprises a pressure monitor in communication with the pressure sensor of each retaining balloon.

The well rescue and support system wherein the screen is an LCD screen.

The well rescue and support system wherein the system further comprises a gas delivery tube fluidly connected to the compressed gas tank through the controller, and wherein the processor comprises instructions to provide a continuous flow of gas from the compressed gas tank to a nozzle located at a distal end of the communication head, and wherein the continuous flow of gas passes through the gas delivery tube.

The well rescue and support system wherein the extendable tube is formed from at least one selected from the group consisting of polyvinyl chloride (PVC), stainless steel, aluminum, and carbon steel.

The well rescue and support system wherein the extendable tube is formed from aluminum.

The well rescue and support system wherein the continuous flow of the gas is delivered to the nozzle at a flow rate of 5 to 12 L/min air or 0.5 to 1 L/min oxygen.

The well rescue and support system wherein the well cap comprises at least one flexible material selected from the group consisting of a silicone, rubber, cork, and polyurethane.

The well rescue and support system wherein the well cap comprises cork.

The well rescue and support system wherein further comprising:

at least one shore protection structure located along the extendable tube, the shore protection structure configured to strengthen soil located along the newly excavated wall of the well structure.

The well rescue and support system wherein the camera is an infrared camera configured to capture images inside the well.

The well rescue and support system wherein each retaining balloon is configured to receive a separate amount of air or oxygen through each inflation valve to inflate each retaining balloon to the target volume, and wherein each retaining balloon is configured to individually inflate to a different target volume.

The well rescue and support system wherein the communication head further comprises a pressure sensor configured to detect a change in pressure within the well.

A well rescue and support system is disclosed to protect trapped victims. A well rescue and support system includes a controller having a processor with program instructions, a compressed gas output valve and a dashboard having a screen and a keypad. A compressed air tank with a regulator connects to the output valve, and a well cap fills a well opening. An extendable tube fluidly connects to the compressed air tank through the output valves. At least three retaining balloons disposed around the extendable tube inflates within the well to apply wall pressure. A communication head with a microphone, a camera, a control wire, and a speaker attach to a balloon end of the extendable tube, connecting to the processor and dashboard through a coaxial cable inside the extendable tube. The processor delivers inflation/deflation signals to balloon valves to control target volumes of the retaining balloons for preventing well collapse during rescue operations.

The disclosed system comprises of an excavator device, an E-data module, V-data module, extendable tube, a controller having an optimizer, control module, output module, execution module and a screen and keypad. Excavator device is utilized to perform vertical excavation operation around the well opening and shares real time data of variable which can influence on the performance of the excavation operation including but not limited to land data, loading data and tool data with the optimizer from E-data module through information sharing medium. V-data module is utilized to receive real time data of variables which can influence the life and comfort of victim using sensors installed on the communication head of the extendable tube through data transfer medium. Extendable tube comprises of data transfer medium, air flow mechanism, duality of retaining balloons, sensors, actuator devices, and communication head of the extendable tube. The extendable tube contains duality of retaining balloons which can change their size as per need in the well during excavation operation to control target volumes of the retaining balloons for prevent collapse during rescue operations. The data transfer medium transfers real time data of variables which can influence the life and comfort of the victim using sensors to V-data module. V-data module is utilized to transfer real time data of variables which can influence the life and comfort of the victim through information sharing medium with optimizer of the controller. An optimizer comprises of an input module and process module. The input module in the optimizer filters E-data and V-data and transfers it to process module to get optimal values of the variables which can influence the performance of excavator device and which can influence on the life and comfort of the victim including but not limited to air, water, oxygen, light, food, temperature, communication and other factors on excavation device. An optimizer shares optimal values of the variables which can influence the performance of the excavator device and optimal values of the variables which can influence the life and comfort of the victim with the execution module and control module of the controller. The control module in the controller is utilized to share the real time information of all variables which can influence on the performance of excavation utilizing excavator and its auxiliary devices to control the performance of excavation process through excavator device. Moreover, the control module in the disclosed system is utilized to share real time information from duality of sensors and actuator devices of the extendable tube which can influence on the life and comfort of the victim including but not limited to air supply device, water supply device, oxygen supply device, light supply device, food supply device other supply devices, temperature control devices, balloon air pressure devices etc. An output module shares an optimal value of all variables with the execution module. The execution module converts the optimal values of all variables which can influence on the performance on the excavation process including optimal operating conditions of excavator and its auxiliary devices and convent them into instructions and shares them with the excavation device through information sharing medium to control the excavation process through excavation device. Moreover, the execution module converts optimal values of all variables which can influence on the life and comfort of the victim including but not limited to optimal air supply, optimal water supply, optimal oxygen supply, optimal light supply, optimal food supply, optimal other supplies, optimal temperature, optimal balloon air pressure and optimal communication with the execution module which converts them into instructions and shares them with actuator device of the protecting rod through information sharing medium.

Numerous modifications and variations of the present disclosure are possible in light of the above teachings. It is therefore to be understood that within the scope of the appended claims, the invention may be practiced otherwise than as specifically described herein.

The invention claimed is:

1. A well rescue and support system, comprising:

a controller having a processor with program instructions, a compressed gas output valve and a dashboard having a screen and a keypad;

a compressed air tank having a regulator, the regulator connected to the compressed gas output valve of the controller by a first tube;

a well cap configured to fill an opening of a well, the well cap having a solid conical body with an axial passage;

an extendable tube passing from the dashboard through the axial passage of the solid conical body of the well cap, the extendable tube fluidly connected to the compressed air tank through the output valve, wherein the extendable tube is connected to the controller at a controller end of the extendable tube;

at least one retaining balloon disposed around the extendable tube and along an axis of the extendable tube, wherein the retaining balloon is proximal to a well end of the extendable tube; and a communication head having a microphone, a camera, a control wire, and a speaker, the communication head attached to a balloon end of the extendable tube, wherein the control wire is electrically connected to the processor and the dashboard of the controller by a coaxial cable disposed inside the extendable tube, wherein the program instructions of the processor in the controller include instructions for lowering the extendable tube into the well and delivering an inflation signal or a deflation signal to a balloon valve located on each retaining balloon, the balloon valve configured to inflate or deflate the retaining balloon within the well structure to a target volume and thereby apply a pressure on a wall of the well to prevent the well from collapsing;

wherein the support system is configured to rescue and provide life support for individuals trapped within the well.

2. The system of claim 1, wherein each retaining balloon is formed from at least one elastomeric material selected from the group consisting of a rubber, a polyurethane, a polybutadiene, a polychloroprene, and a silicone, and wherein each retaining balloon has a channel on an outer surface, the channel having a depth measured from the axis of the balloon of 90% or less a radius of the balloon, and wherein the balloons are staggered along the extendable tube such that the channels for neighboring balloons are not linearly aligned.

3. The system of claim 1, wherein each retaining balloon has a pressure sensor configured to detect a pressure within the retaining balloon and communicate pressure data to the controller.

4. The system of claim 1, wherein the coaxial cable is configured to carry a visual and an audio signal received from the communication head to the control dashboard, and wherein the dashboard is configured to display the visual signal on the screen.

5. The system of claim 1, wherein the screen is at least one selected from the group consisting of a liquid-crystal display (LCD) screen, a light-emitting diode (LED) screen, and an organic light-emitting diode (OLED) screen.

6. The system of claim 1, wherein each retaining balloon is formed of a polyurethane.

7. The system of claim 1, wherein the controller further comprises at least three legs disposed at a bottom end of the controller being attached to configured to stabilize the controller, wherein each leg comprises a flexible joint configured to collapse when the system is not in use.

8. The system of claim 3, wherein the controller further comprises a pressure monitor in communication with the pressure sensor of each retaining balloon.

9. The system of claim 1, wherein the screen is an LCD screen.

10. The system of claim 1, wherein the system further comprises a gas delivery tube fluidly connected to the compressed gas tank through the controller, and wherein the processor comprises instructions to provide a continuous flow of gas from the compressed gas tank to a nozzle located at a distal end of the communication head, and wherein the continuous flow of gas passes through the gas delivery tube.

11. The system of claim 1, wherein the extendable tube is formed from at least one selected from the group consisting of polyvinyl chloride (PVC), stainless steel, aluminum, and carbon steel.

12. The system of claim 1, wherein the extendable tube is formed from aluminum.

13. The system of claim 10, wherein the continuous flow of the gas is delivered to the nozzle at a flow rate of 0.5 to 10 L/min.

14. The system of claim 1, wherein the well cap comprises at least one flexible material selected from the group consisting of a silicone, rubber, cork, and polyurethane.

15. The system of claim 1, wherein the well cap comprises cork.

16. The system of claim 1, further comprising:

at least one shore protection structure located along the extendable tube, the shore protection structure configured to strengthen soil located along at least one wall of the well structure.

17. The system of claim 1, wherein the camera is an infrared camera configured to capture images inside the well.

18. The system of claim 1, wherein each retaining balloon is configured to receive a separate amount of oxygen through each inflation valve to inflate each retaining balloon to the target volume, and wherein each retaining balloon is configured to individually inflate to a different target volume.

19. The system of claim 1, wherein the communication head further comprises a pressure sensor configured to detect a change in pressure within the well.

* * * * *